US011635274B2

(12) United States Patent
Trpkovski

(10) Patent No.: US 11,635,274 B2
(45) Date of Patent: Apr. 25, 2023

(54) PULLEY PROJECTILE LAUNCHER

(71) Applicant: RAVIN CROSSBOWS, LLC, Superior, WI (US)

(72) Inventor: Paul Trpkovski, Kailua Kona, HI (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 0 days.

(21) Appl. No.: 17/022,801

(22) Filed: Sep. 16, 2020

(65) Prior Publication Data

US 2021/0080218 A1 Mar. 18, 2021

Related U.S. Application Data

(60) Provisional application No. 62/901,213, filed on Sep. 16, 2019, provisional application No. 62/902,198, filed on Sep. 18, 2019.

(51) Int. Cl.
*F41B 5/12* (2006.01)

(52) U.S. Cl.
CPC ..... *F41B 5/123* (2013.01)

(58) Field of Classification Search
CPC .. F41B 3/005; F41B 3/02; F41B 5/123; F41B 5/00; F41B 5/12
USPC ..... 124/25
See application file for complete search history.

(56) References Cited

U.S. PATENT DOCUMENTS 3,783,852 A 1/1974 Shepherd
3,854,467 A * 12/1974 Hofmeister ..... F41B 5/105 124/90
4,169,453 A * 10/1979 Hunsicker ..... F41B 3/02 124/20.1
4,169,456 A * 10/1979 Van House ..... F41B 5/12 124/25
4,662,344 A 5/1987 Mitchell
4,703,744 A * 11/1987 Taylor ..... F41B 3/02 124/20.1
5,531,209 A * 7/1996 Liedtke ..... F41B 3/02 124/20.1
5,673,677 A * 10/1997 Wing ..... F41B 3/02 124/17

(Continued)

OTHER PUBLICATIONS

PCT International Searching Authority; International Search Report and Written Opinion of the International Searching Authority for PCT/US2020/051105 dated Dec. 15, 2020; 16 pages.

(Continued)

*Primary Examiner* — John E Simms, Jr.
(74) *Attorney, Agent, or Firm* — Foley & Lardner LLP

(57) ABSTRACT

A projectile launcher includes a frame and a projectile moves within a horizontal projectile plane and along the projectile axis. The projectile is fired from a front end of the frame. The projectile launcher includes a first power group at a first frame side. The first power group includes a plurality of first power group drawstring pulleys. At least one of the plurality of first power group drawstring pulleys is attached to the frame. The projectile launcher further includes a second power group at a second frame side. The second power group includes a plurality of second power group drawstring pulleys. At least one of the plurality of second power group drawstring pulleys is attached to the frame. The drawstring is configured to be routed at least partially around the first and second power group drawstring pulleys.

15 Claims, 43 Drawing Sheets

(56) References Cited

U.S. PATENT DOCUMENTS

| | | | | |
|---|---|---|---|---|
| 5,678,528 | A * | 10/1997 | Hadley | F41B 5/12 124/24.1 |
| 7,047,958 | B1 * | 5/2006 | Colley | F41B 5/10 124/25.6 |
| 7,578,289 | B2 * | 8/2009 | Norkus | F41B 5/0094 124/25 |
| 8,387,603 | B2 | 3/2013 | Darlington | |
| 8,387,604 | B1 | 3/2013 | Terzo | |
| 8,522,762 | B2 | 9/2013 | Trpkovski | |
| 8,651,095 | B2 | 2/2014 | Islas | |
| 8,701,642 | B2 | 4/2014 | Biafore, Jr. et al. | |
| 8,863,732 | B1 * | 10/2014 | Prior | F41B 5/123 124/25 |
| 9,022,013 | B2 | 5/2015 | Trpkovski | |
| 9,234,719 | B1 * | 1/2016 | Kempf | F41B 5/123 |
| 9,255,756 | B1 * | 2/2016 | Wu | F41B 5/123 |
| 9,297,604 | B1 * | 3/2016 | Sidebottom | F41B 5/105 |
| 9,513,080 | B1 * | 12/2016 | Kempf | F41B 5/1411 |
| 9,879,938 | B1 * | 1/2018 | Isenhower | F41B 5/123 |
| 2005/0279338 | A1 * | 12/2005 | Dziekan | F41B 5/1469 124/25 |
| 2008/0251058 | A1 * | 10/2008 | Colley | F41B 5/105 124/25 |
| 2011/0277736 | A1 * | 11/2011 | Flint | F41B 5/12 124/21 |
| 2012/0125302 | A1 * | 5/2012 | Stanziale | F41B 5/123 124/25 |
| 2020/0370856 | A1 * | 11/2020 | Trpkovski | F41B 5/0094 |

OTHER PUBLICATIONS

Knifewarehouse; www.knifewarehouse.co.uk; Black Hawk 99 lb Compound Crossbow—Shoots Bolts & 8mm Steel Balls; Jul. 23, 2020; 3 pages.

* cited by examiner 246
216
204
212
203
A

PULLEY PROJECTILE LAUNCHER

CROSS-REFERENCE TO RELATED APPLICATION(S)

This application claims the benefit of U.S. Provisional Patent Application No. 62/902,198, filed Sep. 18, 2019 and of U.S. Provisional Patent Application No. 62/901,213, filed Sep. 16, 2019, the disclosures of which are hereby incorporated by reference in their entireties. To the extent appropriate, a claim of priority is made to each of the above-disclosed applications.

BACKGROUND

Projectile launchers, such as crossbows and slingshots, utilize a string that is drawn backward and released to fire a projectile. Commonly, a drawstring is used with crossbows and an elastic band is used with slingshots. In crossbows, commonly, flexible limbs are loaded with force by the drawstring being drawn, and limbs are unloaded with force when the crossbow is fired so as to aggressively power the movement of the drawstring toward the front of the crossbow. In slingshots, the flexibility of the elastic band limits how aggressive the elastic band moves toward the front of slingshot when fired.

The more aggressively the drawstring travels to the front of the crossbow/slingshot, the faster a projectile can be fired from the projectile launcher. Therefore, the higher the force required to load the flexible limbs, the faster the flexible limbs become unloaded when the projectile launcher is fired. Similarly, the higher the force it takes to load the flexible limbs, the higher the force required to draw the drawstring. Drawing aids, as well as let-off cams, are often utilized to aid the shooter in both drawing the drawstring and keeping the drawstring drawn until it is released when fired. However, this complicates the overall system.

Therefore, there is a need for a projectile launcher that is capable of firing a projectile at sufficient speeds, while also allowing the shooter to more easily draw the drawstring when arming the projectile launcher.

SUMMARY

This application generally relates to a projectile launcher having a plurality of drawstring pulleys to reduce the draw weight of the projectile launcher.

According to one example of the present disclosure, a projectile launcher is disclosed. The projectile launcher includes a frame having a horizontal projectile plane at a top side in which a projectile axis is positioned. The projectile moves within the horizontal projectile plane and along the projectile axis during firing and arming of the projectile launcher, and the projectile is fired from a front end of the frame. The projectile launcher includes a first flexible limb and a second flexible limb, each first and second limb having a first end attached to the frame and a second end. The first and second flexible limbs are in an unloaded position when the projectile launcher is undrawn and in a loaded position when the projectile launcher is drawn. The projectile launcher includes a first power group at a first frame side, the first power group including a plurality of first power group drawstring pulleys and the first flexible limb. At least one of the plurality of first power group drawstring pulleys is attached to the frame and at least one of the plurality of the first power group drawstring pulleys is attached to the first flexible limb. The projectile launcher further includes a second power group at a second frame side, the second power group including a plurality of second power group drawstring pulleys and the second flexible limb. At least one of the plurality of second power group drawstring pulleys is attached to the frame and at least one of the plurality of second power group drawstring pulleys is attached to the second flexible limb. The projectile launcher further includes a drawstring that has first and second drawstring ends. The drawstring travels at least partially perpendicular to the projectile axis between the first and the second drawstring ends. The drawstring is movable within the projectile plane during firing and arming of the projectile launcher. The drawstring is routed at least partially around the plurality of first power group drawstring pulleys at the first frame side, and the drawstring is routed at least partially around the plurality of second power group drawstring pulleys at the second frame side. The plurality of first and second power group drawstring pulleys are configured to reduce a draw weight of the drawstring.

According to another example of the present disclosure, a projectile launcher is disclosed. The projectile launcher includes a frame defining a horizontal projectile plane at a top side in which a projectile axis is positioned. A projectile moves within the horizontal projectile plane and along the projectile axis during firing and arming of the projectile launcher, and the projectile is fired from a front end of the frame. The projectile launcher includes a first power group at a first frame side, the first power group including a plurality of first power group drawstring pulleys. At least one of the plurality of first power group drawstring pulleys is attached to the frame. A drawstring is configured to be routed at least partially around the first power group drawstring pulleys. The projectile launcher further includes a second power group at a second frame side, the second power group including a plurality of second power group drawstring pulleys. At least one of the plurality of second power group drawstring pulleys is attached to the frame. The drawstring is configured to be routed at least partially around the second power group drawstring pulleys.

According to another example of the present disclosure, a method of forming a projectile launcher is disclosed. The method includes providing a projectile launcher. The projectile launcher includes a frame defining a horizontal projectile plane at a top side in which a projectile axis is positioned. A projectile moves within the horizontal projectile plane and along the projectile axis during firing and arming of the projectile launcher, and the projectile is fired from a front end of the frame. The projectile launcher also includes a first power group at a first frame side, the first power group including a plurality of first power group drawstring pulleys. At least one of the plurality of first power group drawstring pulleys is attached to the frame. The projectile launcher further includes a second power group at a second frame side, the second power group including a plurality of second power group drawstring pulleys. At least one of the plurality of second power group drawstring pulleys is attached to the frame. The projectile launcher further includes a power source connectable to the first and second power groups via a drawstring. The method further includes connecting the power source to a first end of the drawstring, routing the drawstring at least partially around the plurality of first power group drawstring pulleys, routing the drawstring at least partially around the plurality of second power group drawstring pulleys, and connecting the power source to a second end of a drawstring.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

FIG. 1 illustrates the projectile launcher undrawn.

FIG. 15 illustrates the projectile launcher undrawn.

FIG. 29 illustrates the projectile launcher undrawn.

FIG. 42 illustrates the projectile launcher undrawn.

DETAILED DESCRIPTION

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A projectile launcher (e.g., a crossbow and slingshot) disclosed herein can be used in a variety of different arrangements to improve efficiency, improve balance, improve safety, shoot different projectiles, and improve accuracy. The projectile launcher may include a plurality of drawstring pulleys that reroute the drawstring to reduce a draw weight of the drawstring. The draw weight of the drawstring can be defined as the pulling force required to draw the drawstring to a rear of the projectile launcher. By reducing the draw weight of the drawstring, the drawstring can load a powerful flexible limb with less pulling force. Because a powerful flexible limb can be loaded, the flexible limb can power the drawstring more aggressively (i.e., move faster) toward the front of the projectile launcher when firing, thus leading to firing a projectile at a faster speed. The plurality of drawstring pulleys reduce the amount of force needed to draw the drawstring of the projectile launcher while not sacrificing firing power, thus making the projectile launcher accurate and powerful. Further still, the projectile launcher includes a frame that allows the projectile launcher to remain compact and stable while operating efficiently and effectively.

An example of a crossbow is described in U.S. Pat. No. 9,494,379, the disclosure of which is hereby incorporated by reference in its entirety.

FIGS. 1-14 illustrate an example of a projectile launcher 100 according to the principles of the present disclosure. FIGS. 15-24 illustrate an example of a projectile launcher 200 according to the principles of the present disclosure. FIGS. 25-41 illustrate an example of a projectile launcher 300 according to the principles of the present disclosure. FIGS. 42-49 illustrate an example of a projectile launcher 400 according to the principles of the present disclosure. The projectile launchers 100/200/300/400 can each be configured in a variety of different ways, each utilizing components from each embodiment.

Figure 1:
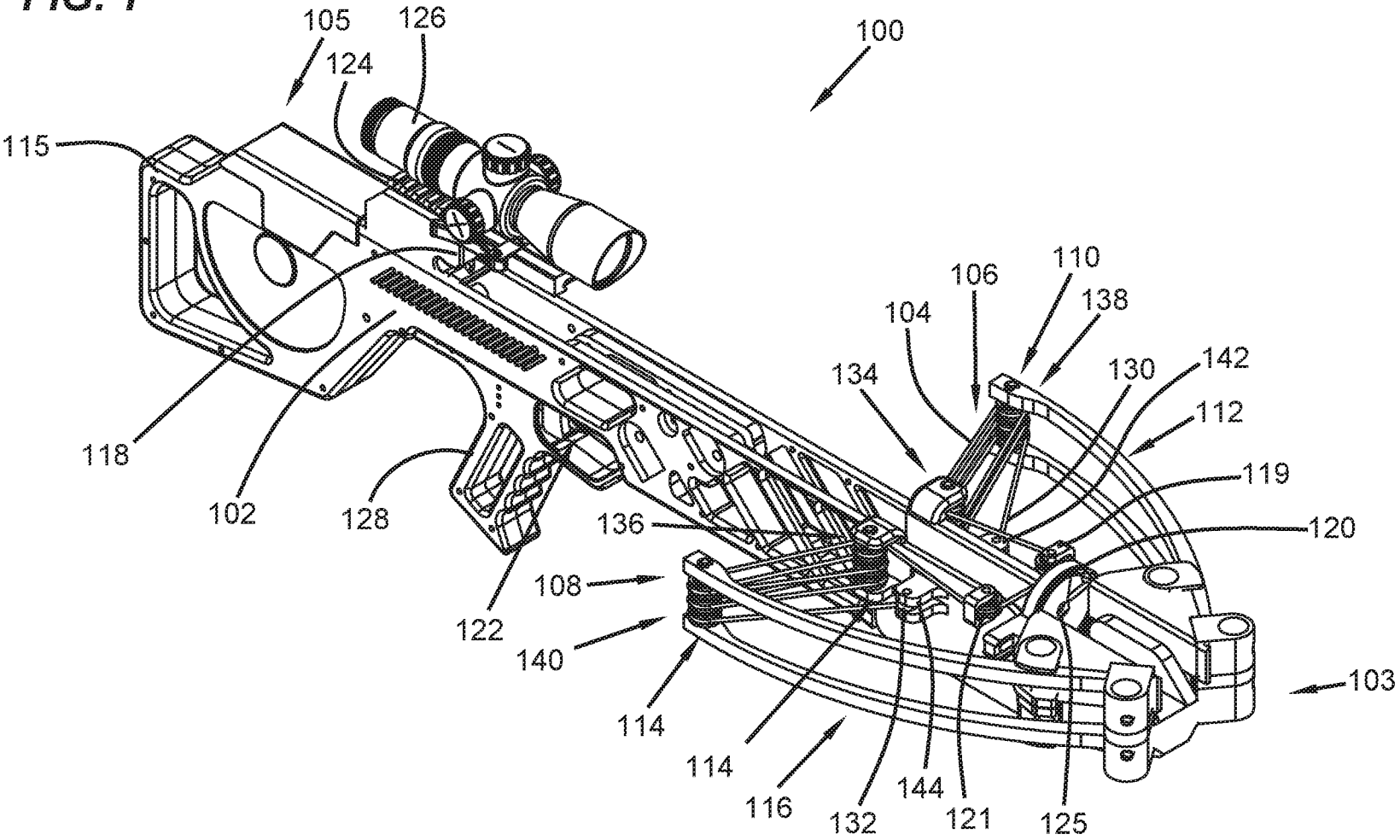
FIG. 1 is a right front perspective view of a projectile launcher according to the principles of the present disclosure; in particular
Figure 2:
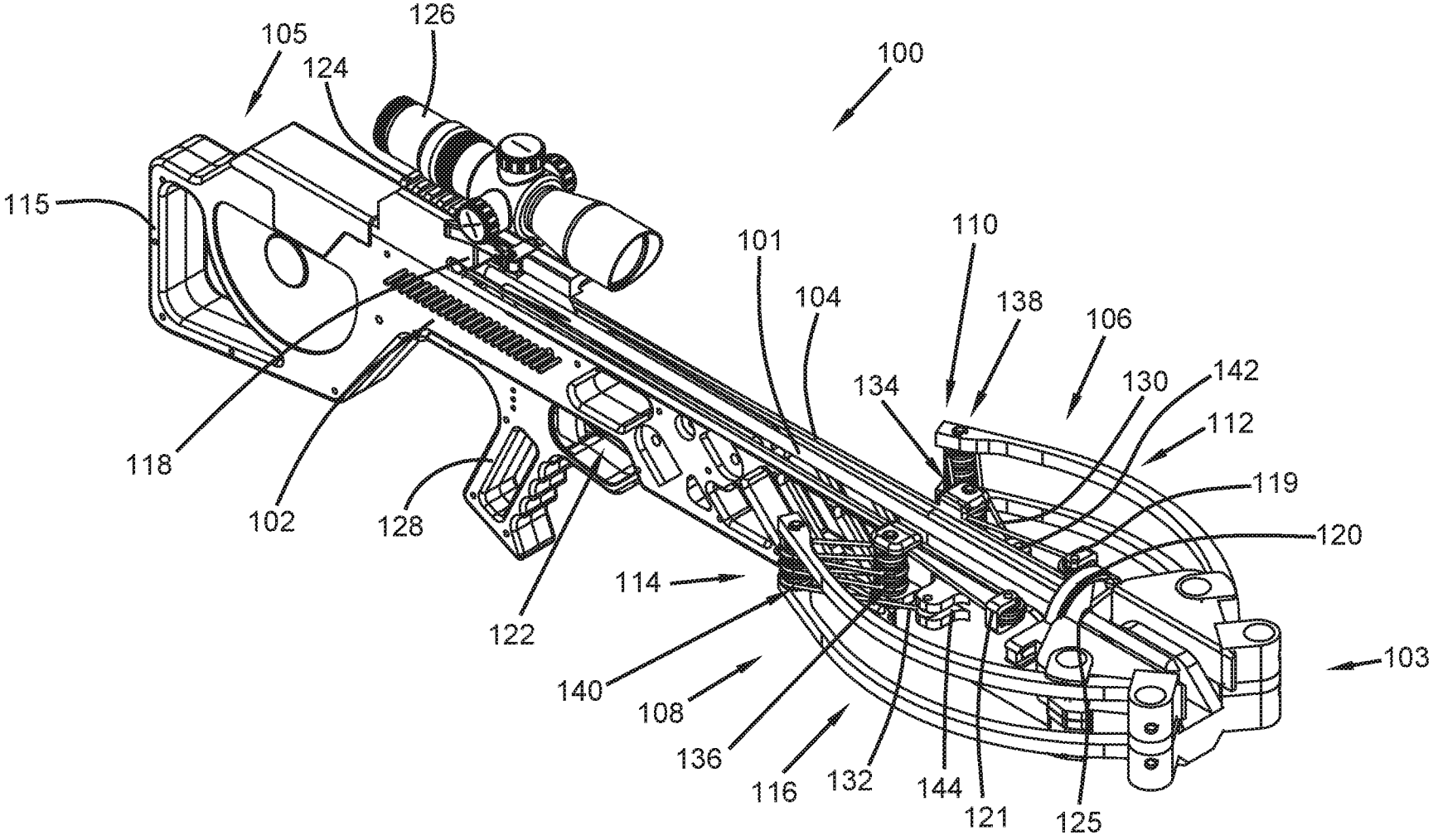
FIG. 2 is another right front perspective view of the projectile launcher of FIG. 1 drawn.
Figure 3:
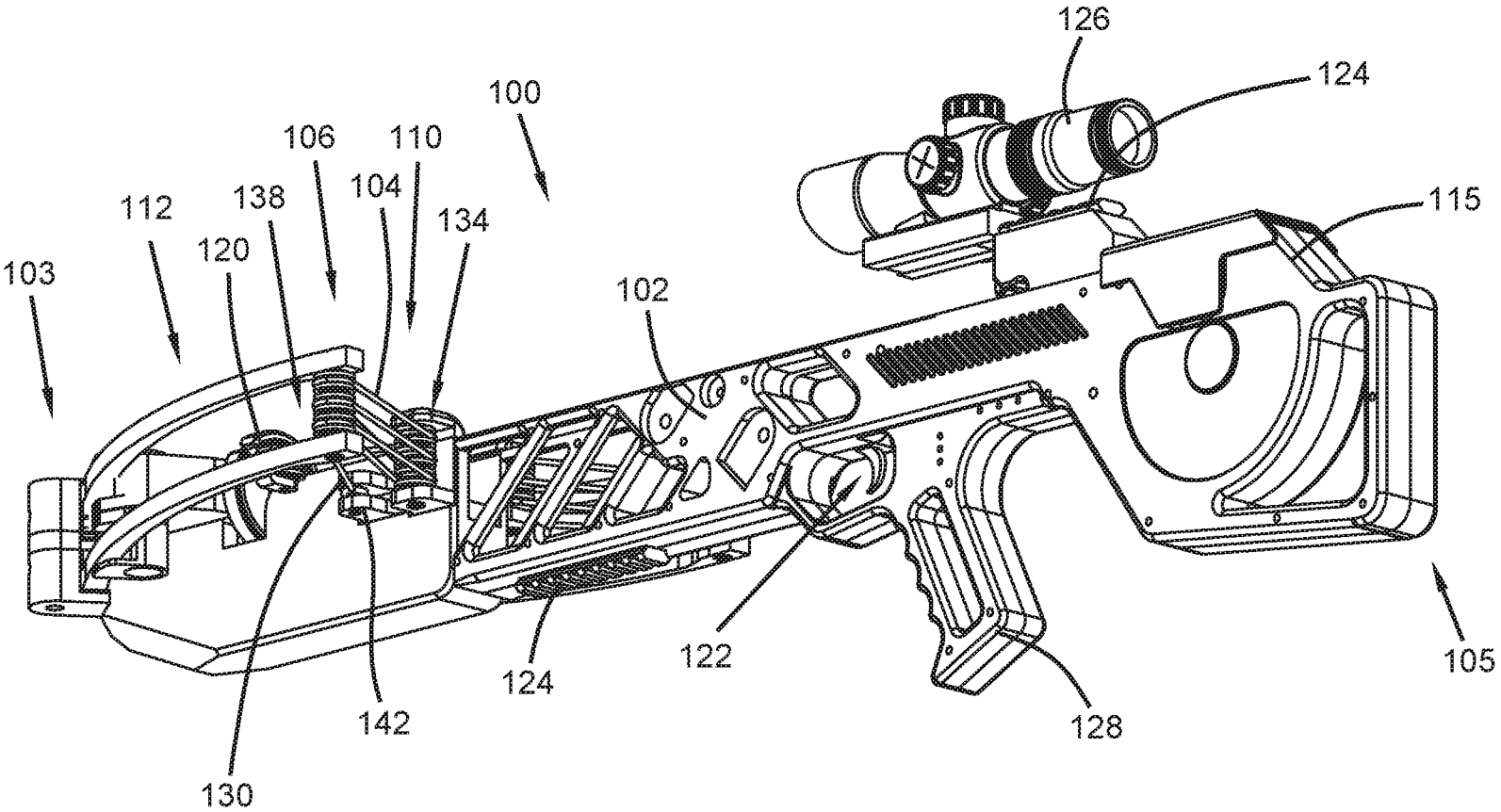
FIG. 3 is left rear perspective view of the projectile launcher of FIG. 1 undrawn.
Figure 4:
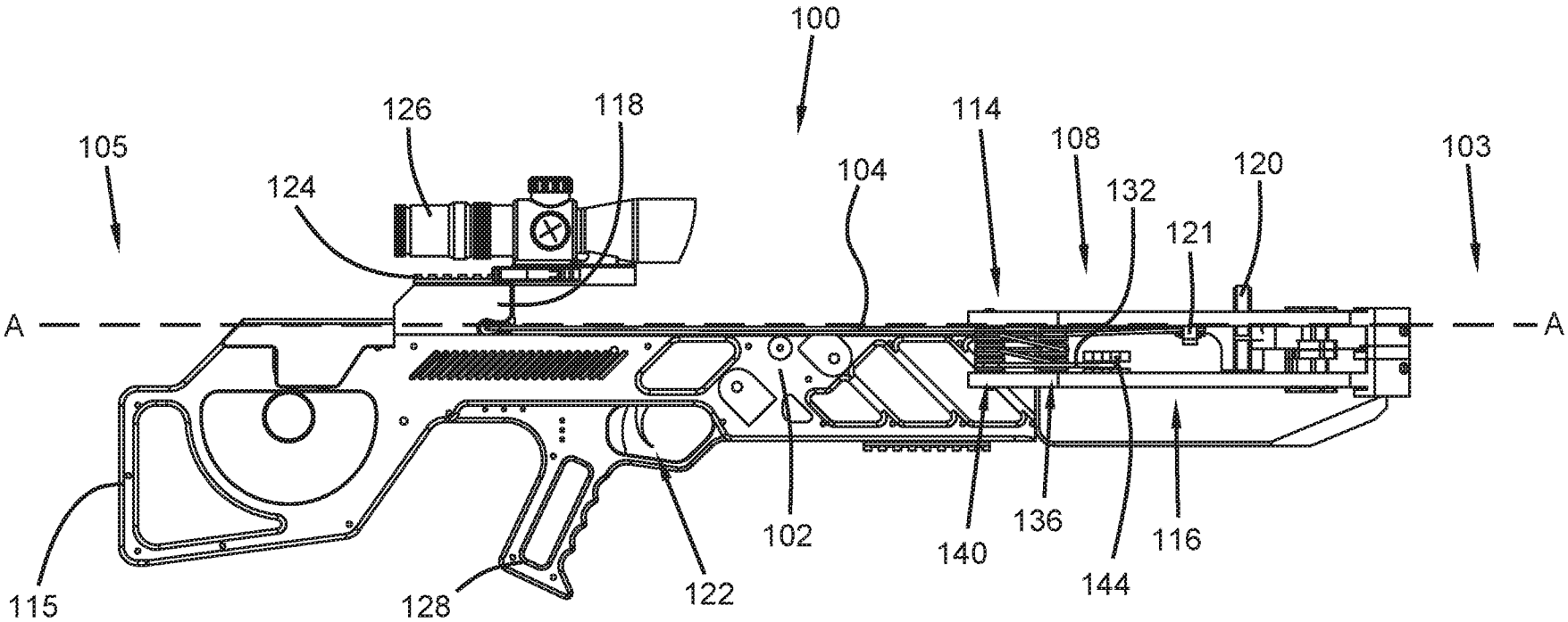
FIG. 4 is a right side view of the projectile launcher of FIG. 1 drawn.
Figure 5:
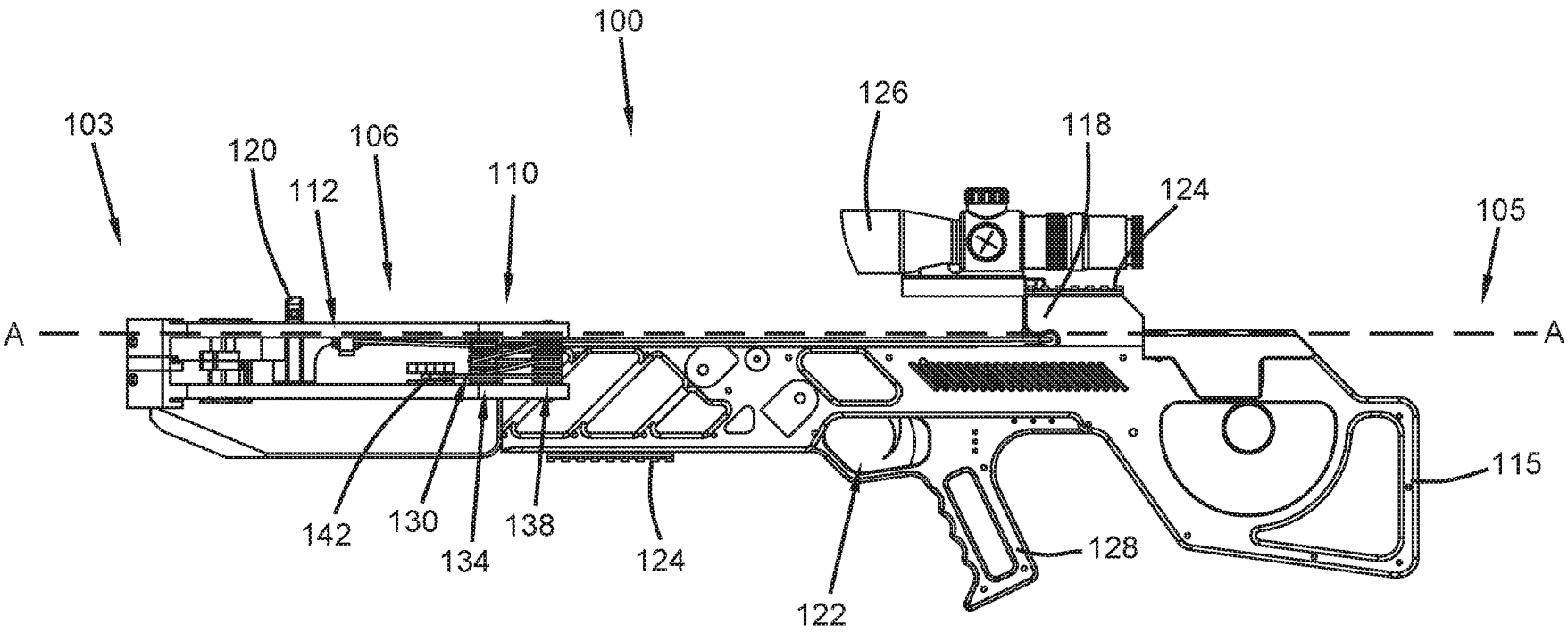
FIG. 5 is a left side view of the projectile launcher of FIG. 1 drawn.
Figure 7:
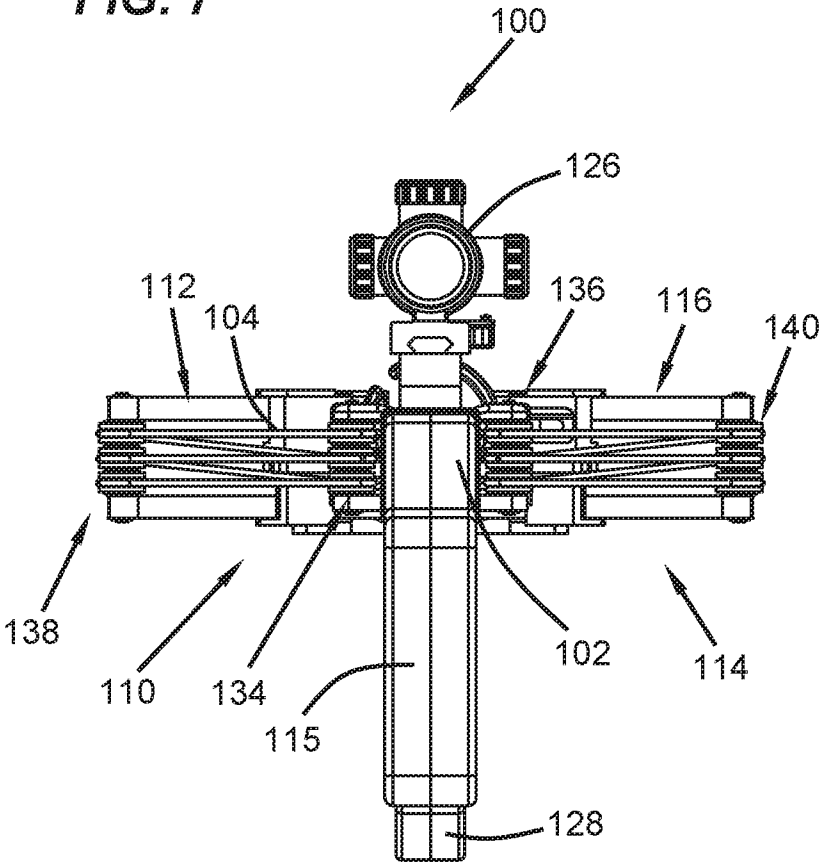
FIG. 7 is a rear side view of the projectile launcher of FIG. 1 undrawn.
Figure 6:
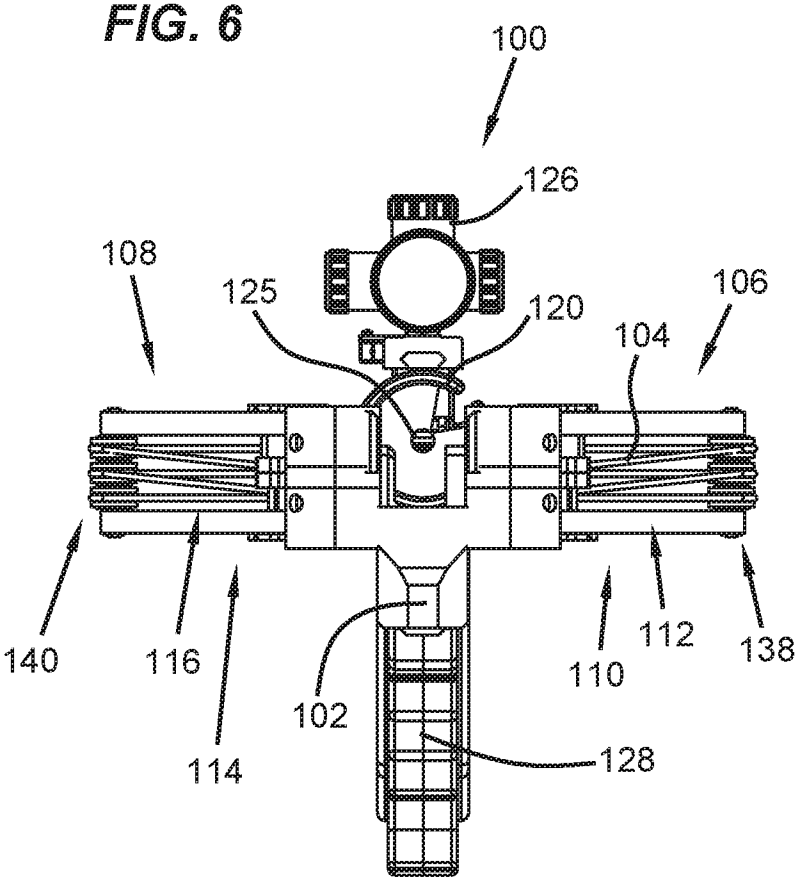
FIG. 6 is a front side view of the projectile launcher of FIG. 1 undrawn.
Figure 9:
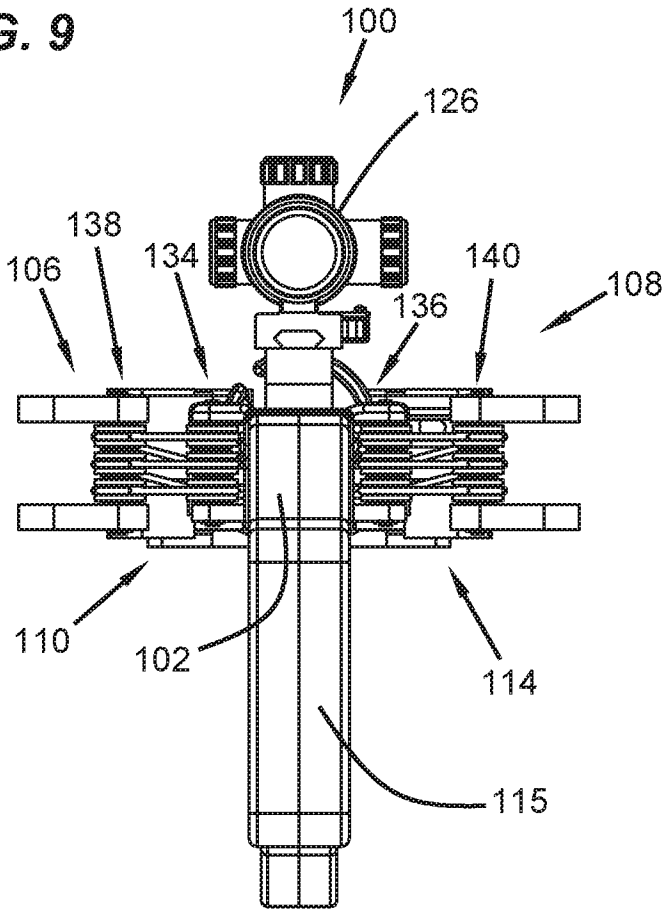
FIG. 9 is a rear side view of the projectile launcher of FIG. 1 drawn.
Figure 8:
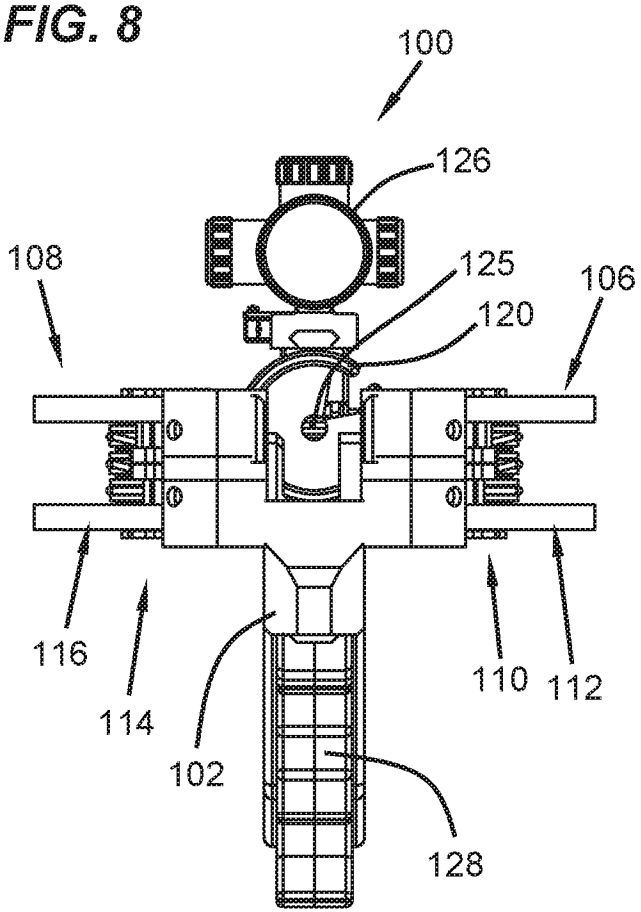
FIG. 8 is a front side view of the projectile launcher of FIG. 1 drawn.
Figure 10:
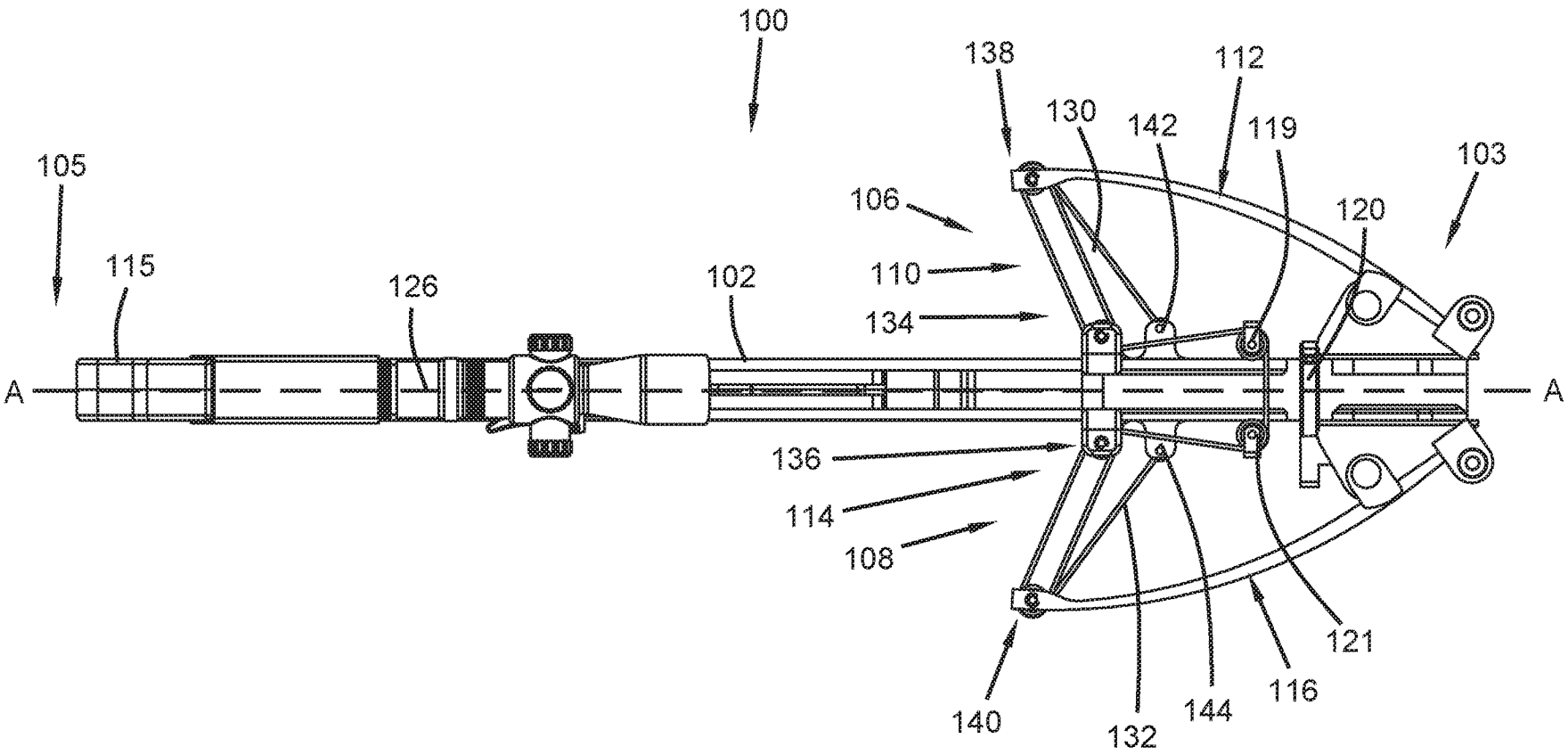
FIG. 10 is a top side view of the projectile launcher of FIG. 1 undrawn.
Figure 11:
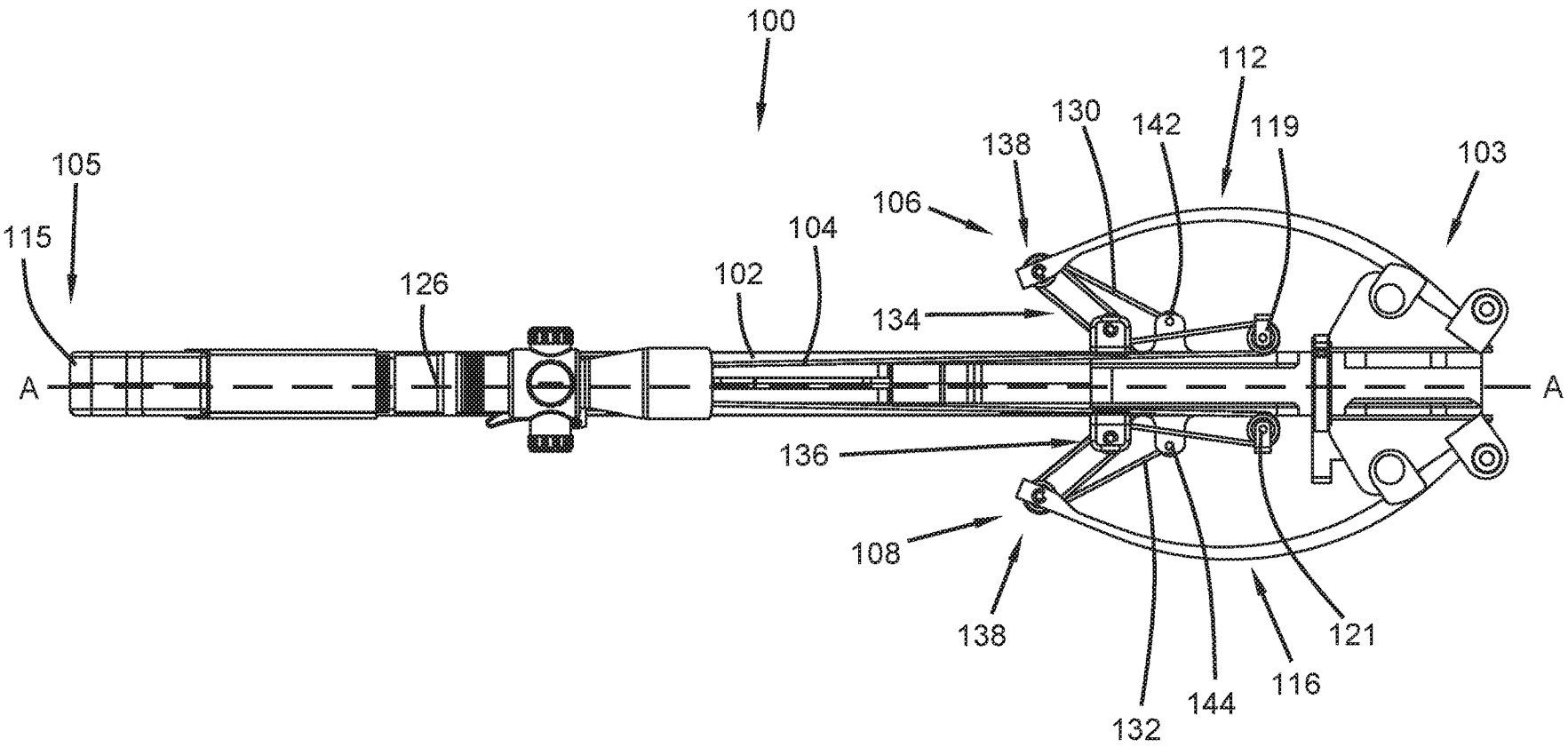
FIG. 11 is a top side view of the projectile launcher of FIG. 1 drawn.

FIG. 1 shows a front perspective view of the projectile launcher 100 undrawn. FIG. 2 shows a front perspective view of the projectile launcher 100 drawn. FIG. 3 shows a rear perspective view of the projectile launcher 100 undrawn. FIGS. 4-5 show side views of the projectile launcher 100 undrawn. FIGS. 6-7 show front and rear views of the projectile launcher 100 undrawn. FIGS. 8-9 show front and rear views of the projectile launcher 100 drawn. FIG. 10 shows a top view of the projectile launcher 100 undrawn. FIG. 11 shows a top view of the projectile launcher 100 drawn. In the depicted embodiment, the projectile launcher 100 is a crossbow.

The projectile launcher 100 is configured to fire a projectile 101, such as an arrow. The projectile launcher 100 includes a frame 102, a drawstring 104, a first power group 106 including a plurality of first power group drawstring pulleys 110 and a first flexible limb 112, a second power group 108 including a plurality of second power group drawstring pulleys 114 and a second flexible limb 116, a first drawstring guide 119, a second drawstring guide 121, a latch 118, a projectile rest 120, and a trigger assembly 122. The projectile launcher 100 also can include an accessory rail 124, a sighting apparatus 126, and a grip 128. When fired, the projectile 101 moves within a horizontal projectile plane and along a projectile axis A, and the projectile launcher 100 fires the projectile 101 from a front end 103 of the frame 102. In some examples, the projectile launcher 100 is generally symmetrical about the projectile axis A.

The projectile 101 can be a variety of different projectiles such as, but not limited to, an arrow, a metal ball, a metal rod, etc. For example, the projectile 101 is an arrow with a pointed tip and fletching to help guide and steer the arrow when the arrow is fired from the projectile launcher 100.

The frame 102 can be constructed of a composite, wood, metal, or like material. In some examples, the frame 102 includes an integral stock 115 at a rear end 105. In some examples, the stock 115 is attached to, and separate from, the frame 102. In some examples, the projectile launcher 100 does not include a stock 115 and can be configured to fire like a pistol. In some examples, the frame 102 is a singular unibody component. In other examples, the frame 102 has a multiple-piece construction. In some examples, the frame 102 is configured to include a variety of different mounting points for various modular accessories such as a quiver, a scope, a flashlight, or other attachments.

The drawstring 104, in some examples, is coupled to the flexible limbs 112, 116 and the frame 102 via the first and second power groups 106, 108. The flexible limbs 112, 116 power movement of the drawstring 104. The flexible limbs 112, 116 are a power source. However, it is considered within the scope of the present disclosure that the power source can be any of a variety of source such as, but not limited to, spring(s) and/or motor(s). The drawstring 104 is replaceable, such as when it is worn, for example. In some examples, the projectile launcher 100 is provided without a drawstring 104, and the drawstring 104 can be subsequently added by a user or technician. The drawstring 104 can be constructed of traditional bowstring material such as, but not limited to, composite and/or natural fibers.

The drawstring 104 travels at least partially perpendicular to the projectile axis A. The drawstring 104 is movable within a projectile plane during firing and arming of the projectile launcher 100. To draw the drawstring 104, the projectile launcher 100 is stabilized and the drawstring 104 is pulled to the rear end 105 of the frame 102. An arming device, the user's arm, or other like mechanism can be used to draw the drawstring 104. In the depicted embodiment, first and second ends 130, 132 of drawstring 104 are attached to opposite sides of the frame 102. In some examples, first and second ends 130, 132 of drawstring 104 are attached to the flexible limbs 112, 116.

The first power group 106 includes the plurality of first power group drawstring pulleys 110 and the first flexible limb 112. The second power group 108 includes the plurality of second power group drawstring pulleys 114 and the second flexible limb 116.

The flexible limbs 112, 116 are coupled to the drawstring 104 and attached to the frame 102. In some examples, the limbs 112, 116 are elastic and spring-like in nature. In some examples, the limbs 112, 116 extend in an outward direction from the frame 102 and in a rearward direction toward the rear end 105 of the frame 102. In some examples, the limbs 112, 116 extend in an outward direction from the frame 102 and/or in a forward direction toward the front end 103 of the frame 102. In some examples, the limbs 112, 116 extend in an upward direction from the frame 102 and/or in a forward direction toward the front end 103 of the frame 102. In some examples, the limbs 112, 116 extend in an upward direction from the frame 102 and/or in a rearward direction toward the rear end 105 of the frame 102. It is considered within the scope of the present disclosure that the limbs 112, 116 may be positioned in a variety of different ways relative to the frame 102. The limbs 112, 116 are positioned at either side of the frame 102 such that the projectile 101 passes between the limbs 112, 116.

The first and second power group drawstring pulleys 110, 114 reroute the drawstring 104 to aid in reducing the draw weight of the drawstring 104. For every drawstring pulley 110, 114 that reroutes the drawstring 104, the force that is required to draw the drawstring, thereby simultaneously pulling the flexible limbs 112, 116 closer the frame 102, is reduced. Therefore, a variety of different numbers of pulleys 110, 114 can be utilized. Specifically, the frame 102 can include first and second power group frame pulleys 134, 136 mounted thereto and the limbs 112, 116 can include first and second power group limb pulleys 138, 140 mounted thereto.

As shown, the drawstring 104 is attached at a first mounting point 142 to frame 102, then routed within the first power group 106 before crossing the projectile axis A and being routed within the second power group 108 before being attached at a second mounting point 144 to the frame 102. Specifically, the drawstring 104 is attached at the first mounting point 142 and routed around a single pulley of the first power group limb pulleys 138, then routed around a single pulley of the first power group frame pulleys 134, then routed back around a single pulley of the first power group limb pulleys 138, then routed around a single pulley of the first power group frame pulleys 134, then routed back around a single pulley of the first power group limb pulleys 138, and then finally routed around a single pulley of the first power group frame pulleys 134 before being routed around the first drawstring guide 119 and across the projectile axis A and around the second drawstring guide 121. Once routed around the second drawstring guide 121, the drawstring 104 is routed around a single pulley of the second power group frame pulleys 136, then routed back around a single pulley of the first power group limb pulleys 140, then routed around a single pulley of the first power group frame pulleys 136, then routed back around a single pulley of the first power group limb pulleys 140, and then routed around a single pulley of the second power group frame pulleys 136, and then finally routed back around a single pulley of the first power group limb pulleys 140 before being attached to the second mounting point 144 attached to the frame 102. The first and second power group drawstring pulleys 110, 114 will be discussed in more detail with respect FIGS. 12-14.

The first and second drawstring guides 119, 121 are attached to the frame 102. Each guide 119, 121 guides the drawstring 104 across the projectile axis A between the first and second ends 130,132 of the drawstring 104. In some examples, the first and second drawstring guides 119, 121 help to maintain the timing of either side of the drawstring 104 during firing so that the drawstring 104 propels the projectile 101 in an even manner. When undrawn, the drawstring 104 remains biased and tensioned around the first and second drawstring guides 119, 121, thus ensuring a lack of slack of the drawstring 104. The projectile launcher 100 is configured so that the drawstring 104 is coupled with the limbs 112, 116 and the limbs 112, 116 exert a force the drawstring 104 when undrawn, thereby pulling the drawstring 104 to the front end 103 of the frame 102 against the first and second drawstring guides 119, 121.

The latch 118 is configured to hold the drawstring 104 at the rear end 105 of the frame when the projectile launcher 100 is drawn. In some examples, the latch 118 can interface with a shuttle attached to the drawstring 104. In some examples, the latch 118 is movable along a rail between the front and rear ends 103, 105 of the frame 102. In some examples, the latch 118 is attached to the frame 102 via a tether that extends and retracts into the frame 102.

The projectile rest 120 is mounted to the front end 103 of the frame 102 and includes an opening 125 that is aligned with projectile axis A for supporting the projectile 101. In some examples, the projectile rest 120 includes bristles positioned within the opening 125 for supporting the projectile 101. In some examples, the projectile rest 120 can include arms to cradle the projectile 101.

The trigger assembly 122 is in communication with the latch 118 so that upon activation of the trigger assembly 122 when firing (e.g., pulling the trigger toward the rear end 105 of the frame 102), the trigger assembly 122 moves portions the latch 118 and the drawstring 104 is released and free to travel toward the front end 103 of the frame 102. In some examples, the trigger assembly 122 includes a safety and/or anti-dry fire protection.

The projectile launcher 100 can include a plurality of accessory rails 124. In some examples, the accessory rail 124 can be a picatinny rail. In some examples, the accessory rail 124 is configured to receive the sighting apparatus 126, such as a scope. In some examples, one of the accessory rails 124 is configured to receive a lighting device, such as a flashlight. In some examples, one of the accessory rails 124 is configured to receive a quiver.

The grip 128 provides a point of support for a user of the projectile launcher 100. The grip 128 can be held by the user's hand, including when operating the trigger assembly 122. The grip 128 assists the user in stabilizing the projectile launcher 100 during firing and handling. In some embodiments, the grip 128 is mounted to the frame 102. In some embodiments, the projectile launcher 100 has a plurality of grips 128 mounted to the frame 102.

Figure 12:
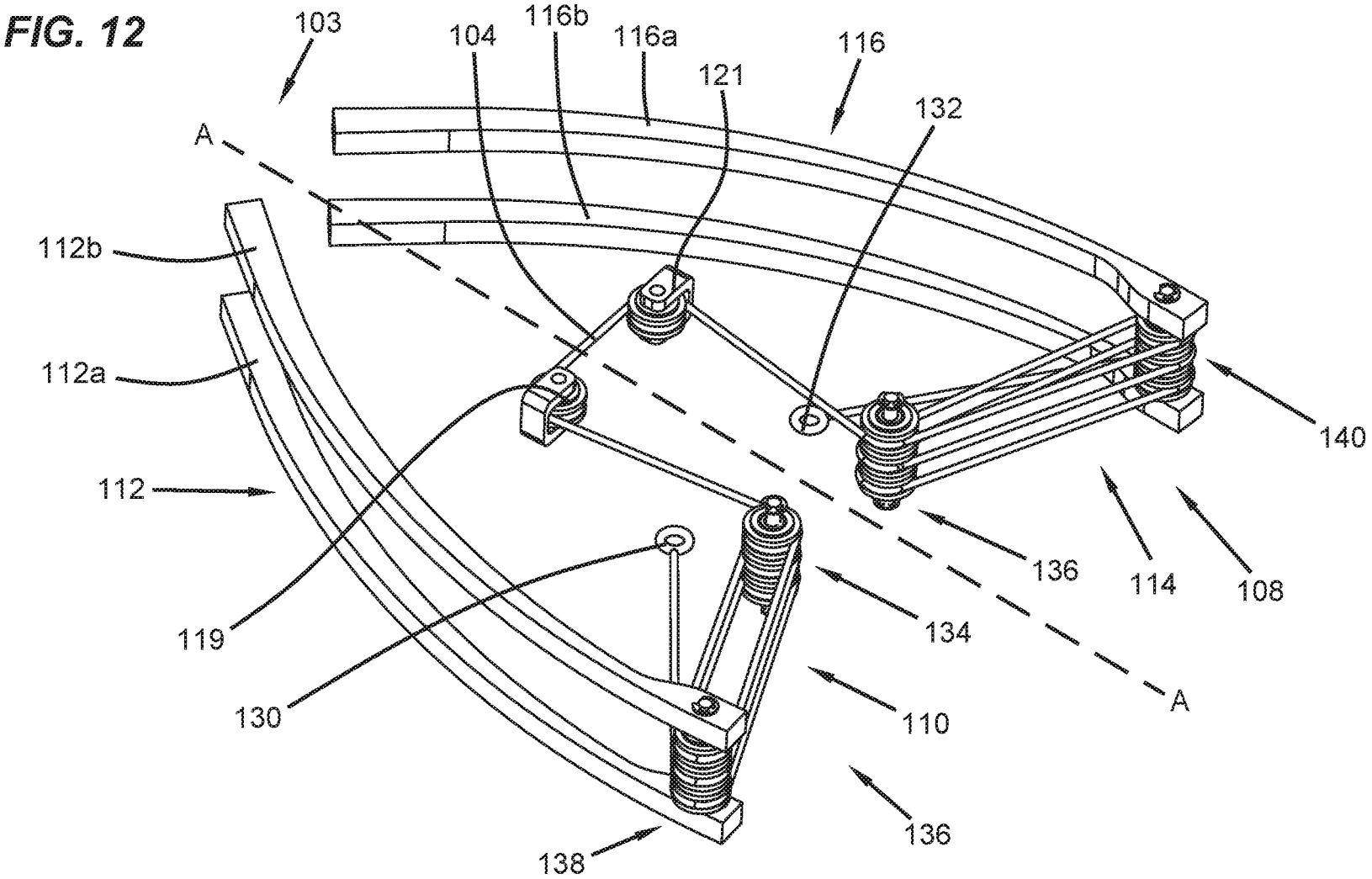
FIG. 12 is a left side rear perspective view of a portion of the projectile launcher of FIG. 1 in the undrawn position.
Figure 13:
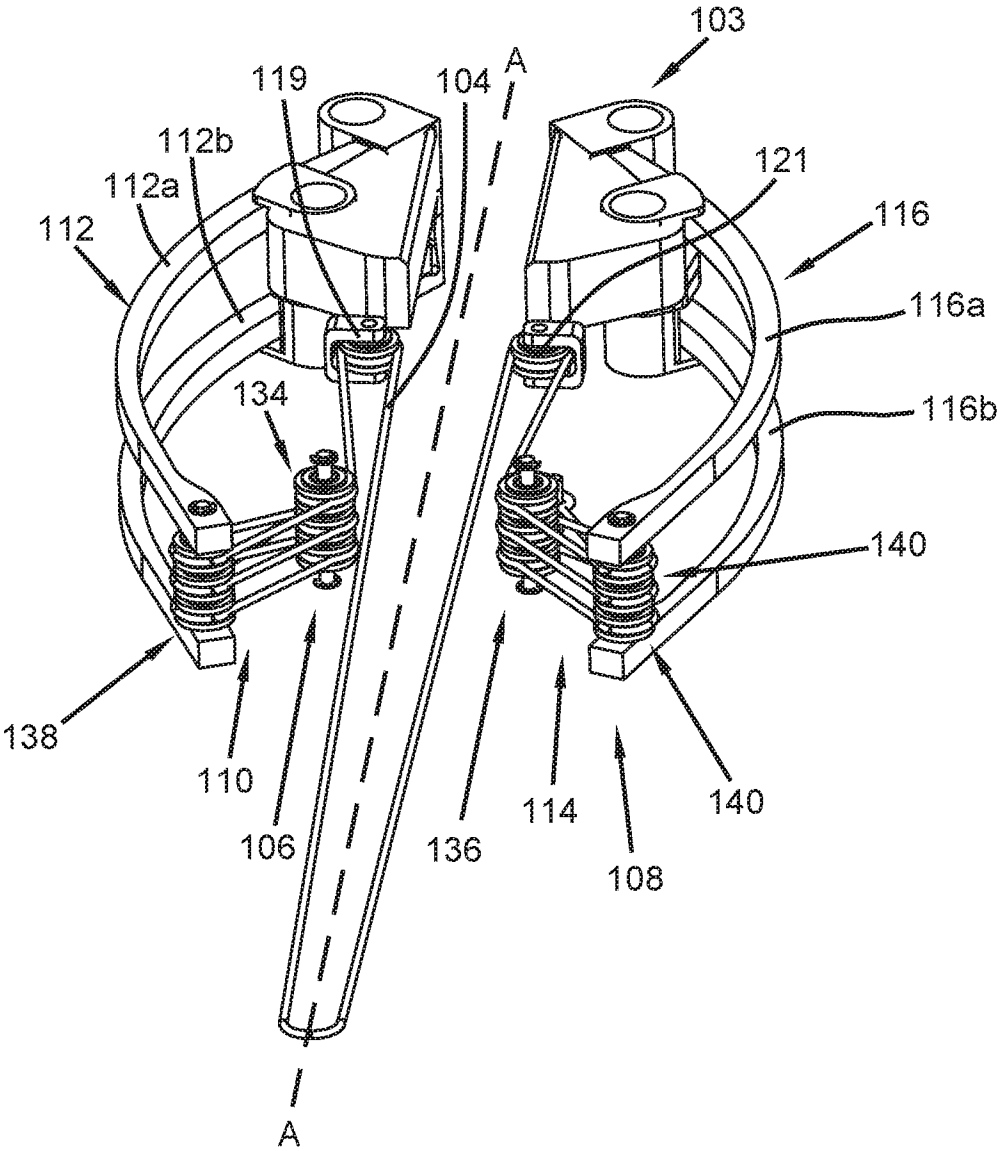
FIG. 13 is a right side rear perspective view of a portion of the projectile launcher of FIG. 1 in the drawn position.

FIG. 12 shows a portion of the projectile launcher 100 with the frame 102 removed and the drawstring 104 undrawn and routed within first and second power groups 106, 108 and the drawstring guides 119, 121. FIG. 13 shows a perspective view of the drawstring 104 drawn. As shown, the first and second limbs 112, 116 each include separate members 112*a*/112*b*, 116*a*/116*b*. The separate members of each of the first and second limbs 112, 116 are configured to flex together by way of the drawstring 104. It is considered within the scope of the present disclosure that the first and second limbs 112, 116 can include any number of separate members.

When moving from undrawn to drawn, the drawstring 104 moves to pull the limbs 112, 116 closer to the frame 102. Said another way, the drawstring 104 pulls the first and second power group limb pulleys 138, 140 toward the first and second power group frame pulleys 134, 136.

Figure 14:
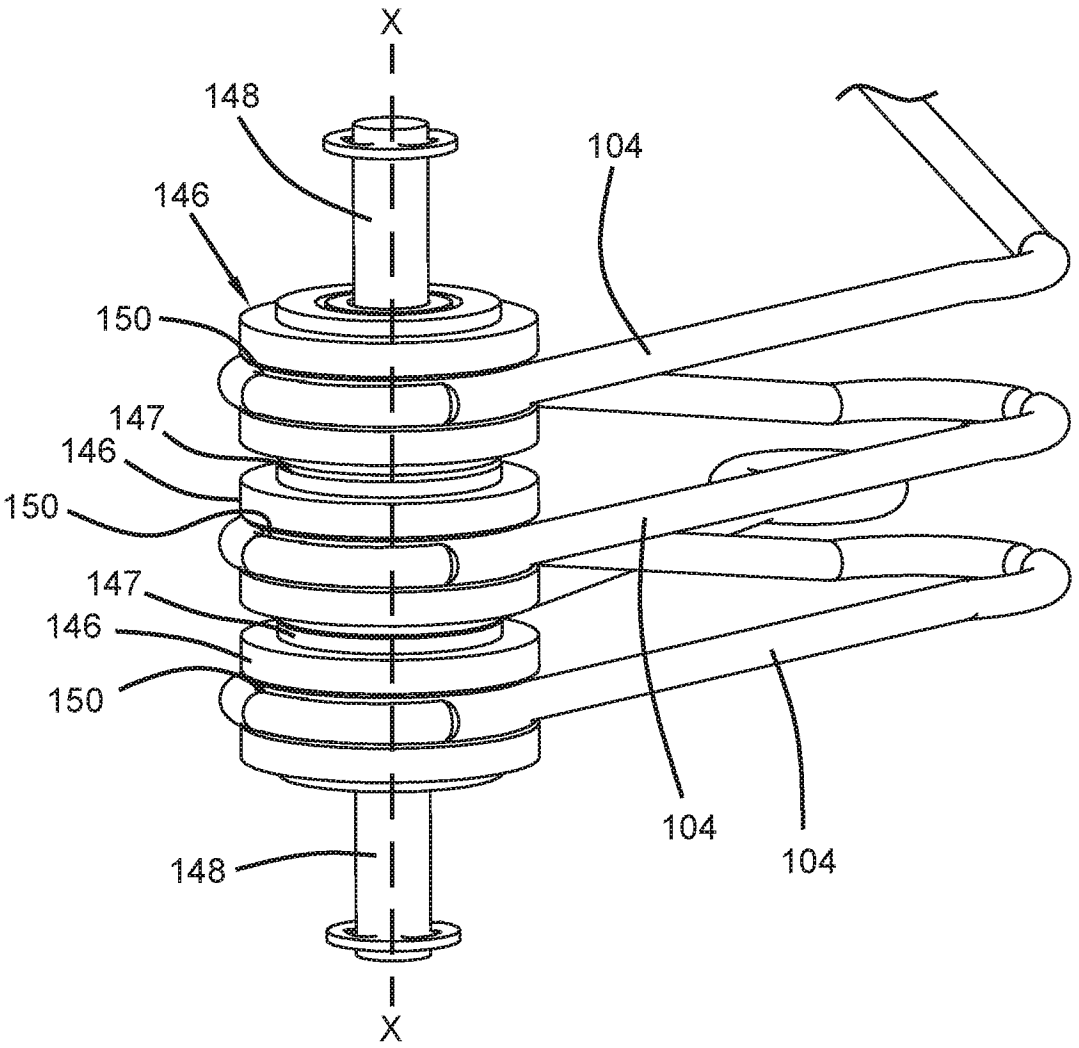
FIG. 14 is a perspective view of a plurality of pulleys of the projectile launcher of FIG. 1.

FIG. 14 shows a perspective view of the first power group limb pulleys 138. While the first power group limb pulleys 138 are shown, the following description can also apply to the second power group limb pulleys 140 and first and second power group frame pulleys 134, 136. As shown, the first power group limb pulleys 138 include single pulleys 146 coaxially arranged around a central axis X. As shown, the pulleys 146 are positioned around a single shaft 148. In some examples, the pulleys 146 are positioned around separate shafts. In some examples, the pulleys 146 are rotatable around the shaft 148. In some examples, the pulleys 146 each include bearings/bushings between the pulley 146 and shaft 148 to allow the pulley 146 to freely rotate around the shaft 148. In some examples, the pulleys 146 are fixed to the shaft 148 and or/the drawstring 104. In some examples, the shaft 148 is mounted to the limbs or frame via bearings/bushings to allow the shaft 148 to rotate relative to the frame or limbs. While three pulleys 146 are shown positioned around the shaft 148, it is considered within the scope of the present disclosure that the shaft 148 can include any number of pulleys 146. For example, where the drawstring 104 is attached to the first limb 112, the first power group limb pulleys 138 can include three pulleys and the first power group frame pulleys 134 can have four pulleys. In some examples, the a spacer 147 can be positioned between each pulley to ensure the pulleys 146 can each individually rotate separately without interfering with the other.

Each pulley includes a groove 150 sized and shaped to receive the drawstring 104. In some examples, the groove 150 can be positioned around a circumference of the pulley 146. In some examples, each pulley 146 can include multiple grooves 150. In some examples, the pulley 146 is constructed from a low friction material to allow the drawstring 104 to move effortlessly relative thereto. In such an example, the pulleys 146 can be fixed relative to the shaft 148. In some examples, the pulleys 146 are constructed in a way to allow the drawstring 104 to grip and rotate the pulleys 146 as the drawstring 104 is moved between the undrawn and drawn position. For example, the groove 150 can be textured, e.g., lined with a high grip material or mechanical feature to grab the drawstring 104. While the pulleys 146 are shown as circular, the pulleys 146 can also have other shapes, such as lobe-shaped.

Figure 15:
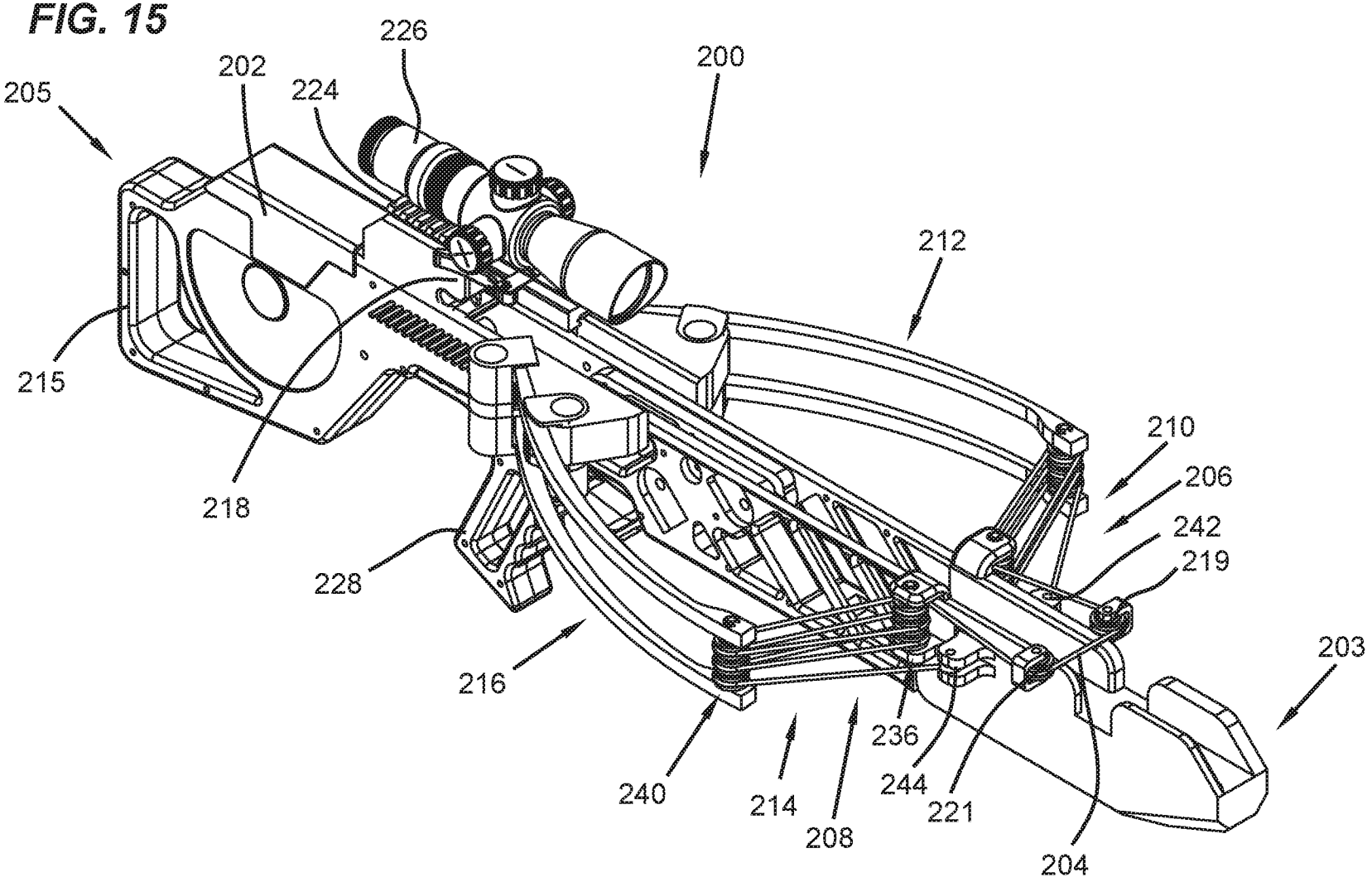
FIG. 15 is a right front perspective view of a projectile launcher according to the principles of the present disclosure; in particular
Figure 16:
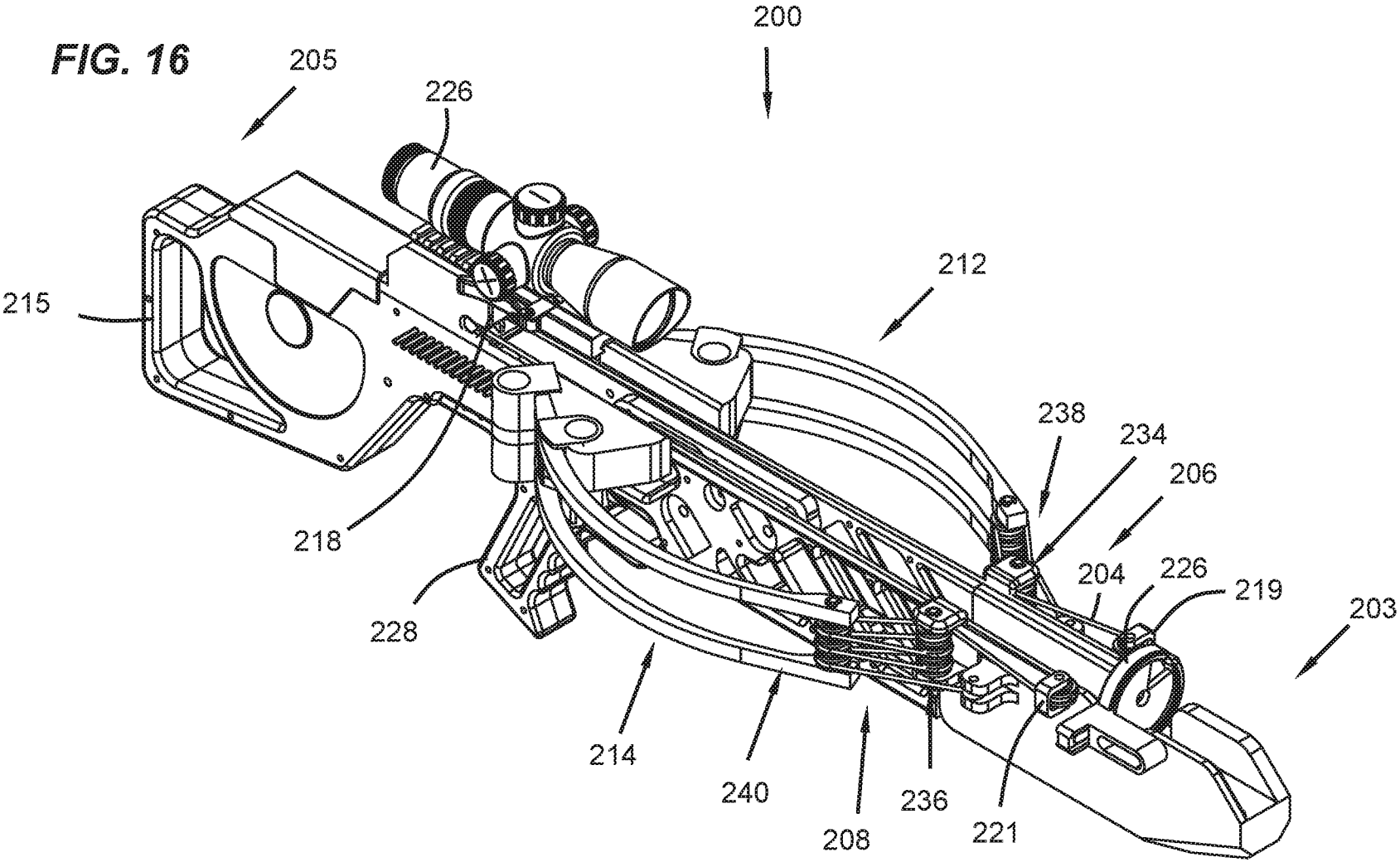
FIG. 16 is another right front perspective view of the projectile launcher of FIG. 15 drawn.

FIG. 15 shows a front perspective view of a projectile launcher 200 undrawn. FIG. 16 shows a front perspective view of the projectile launcher 200 drawn. The projectile launcher 200 is substantially similar to the projectile launcher 100, described above. The projectile launcher 200 has forward facing first and second limbs 212, 216, compared to the rearward facing first and second limbs 112, 116 of the projectile launcher 100.

The projectile launcher 200 includes a frame 202 with a front end 203 and a rear end 205, a drawstring 204, a first power group 206 including a plurality of first power group drawstring pulleys 210 and a first flexible limb 212, a second power group 208 including a plurality of second power group drawstring pulleys 214 and a second flexible limb 216, a first drawstring guide 219, a second drawstring guide 221, a latch 218, a projectile rest 220, and a trigger assembly 222. The projectile launcher 200 also can includes a stock 215, an accessory rail 224, a sighting apparatus 226, and a grip 228. In the depicted embodiment, the projectile launcher 200 is a crossbow. As shown, the first and second drawstring guides 219, 221 are positioned forward, i.e., closer to the front end 203 of the projectile launcher 200, than the entire first and second limbs 212, 216.

Figure 17:
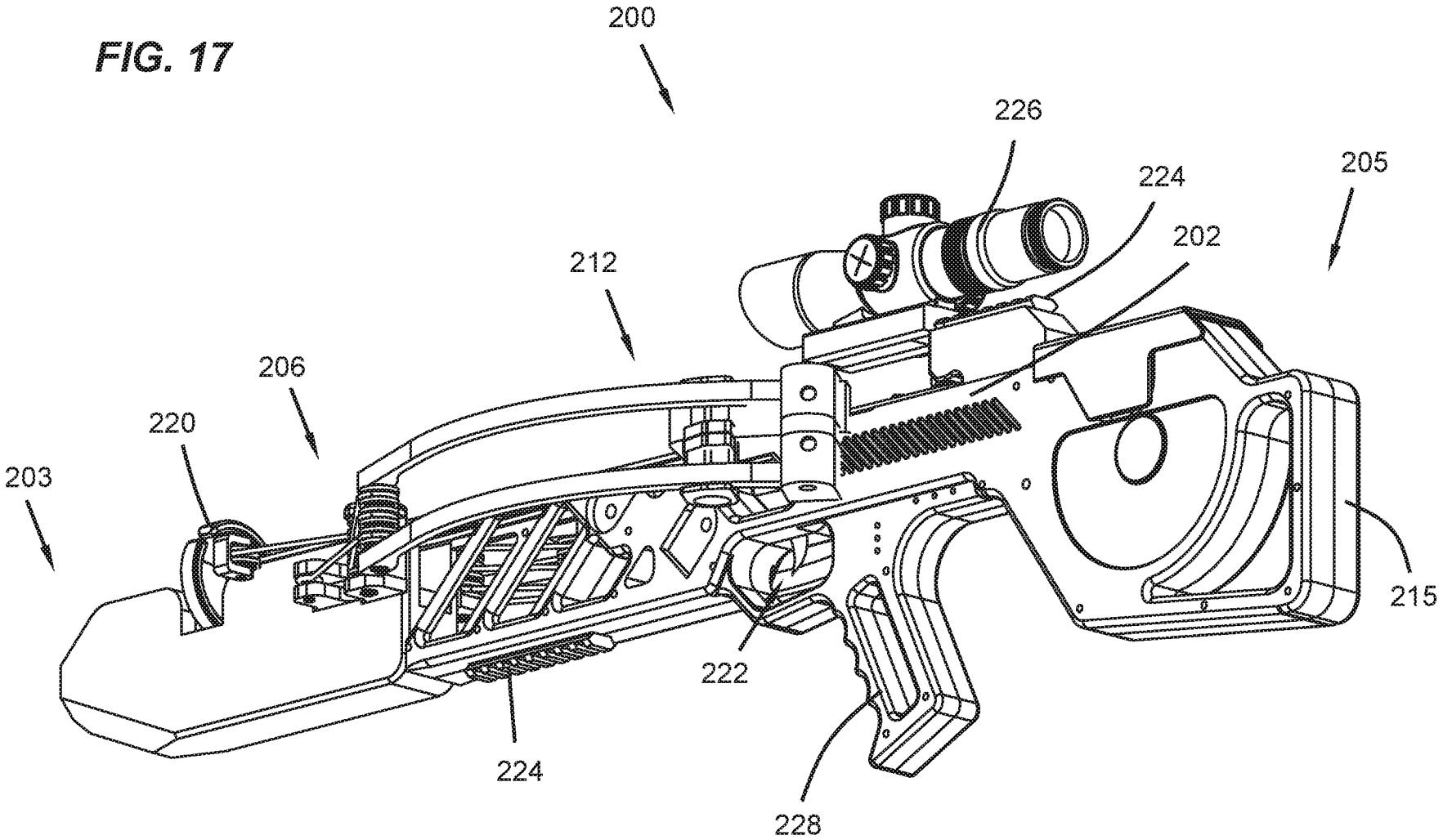
FIG. 17 is left rear perspective view of the projectile launcher of FIG. 15 undrawn.
Figure 18:
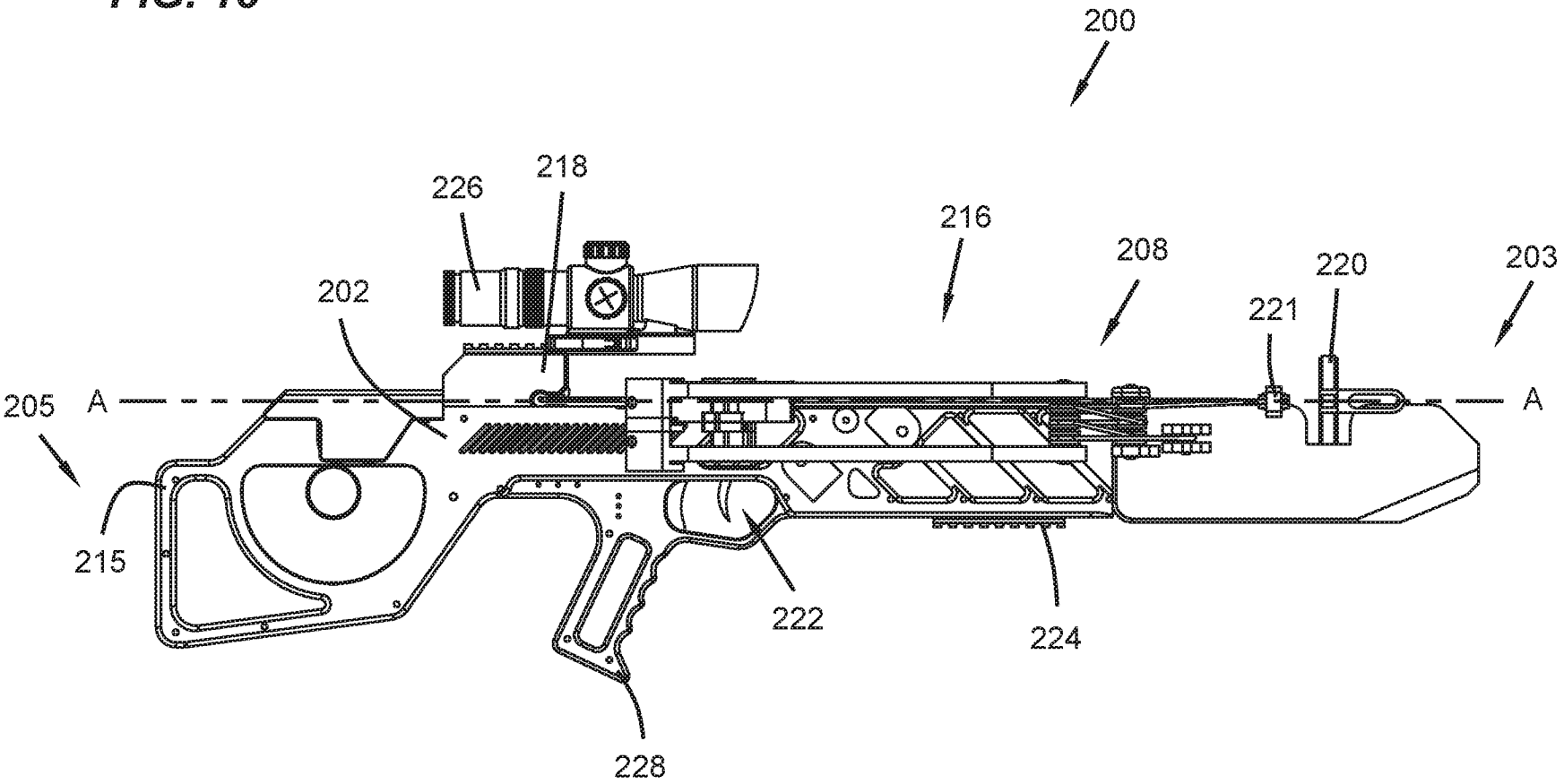
FIG. 18 is a right side view of the projectile launcher of FIG. 15 drawn.
Figure 19:
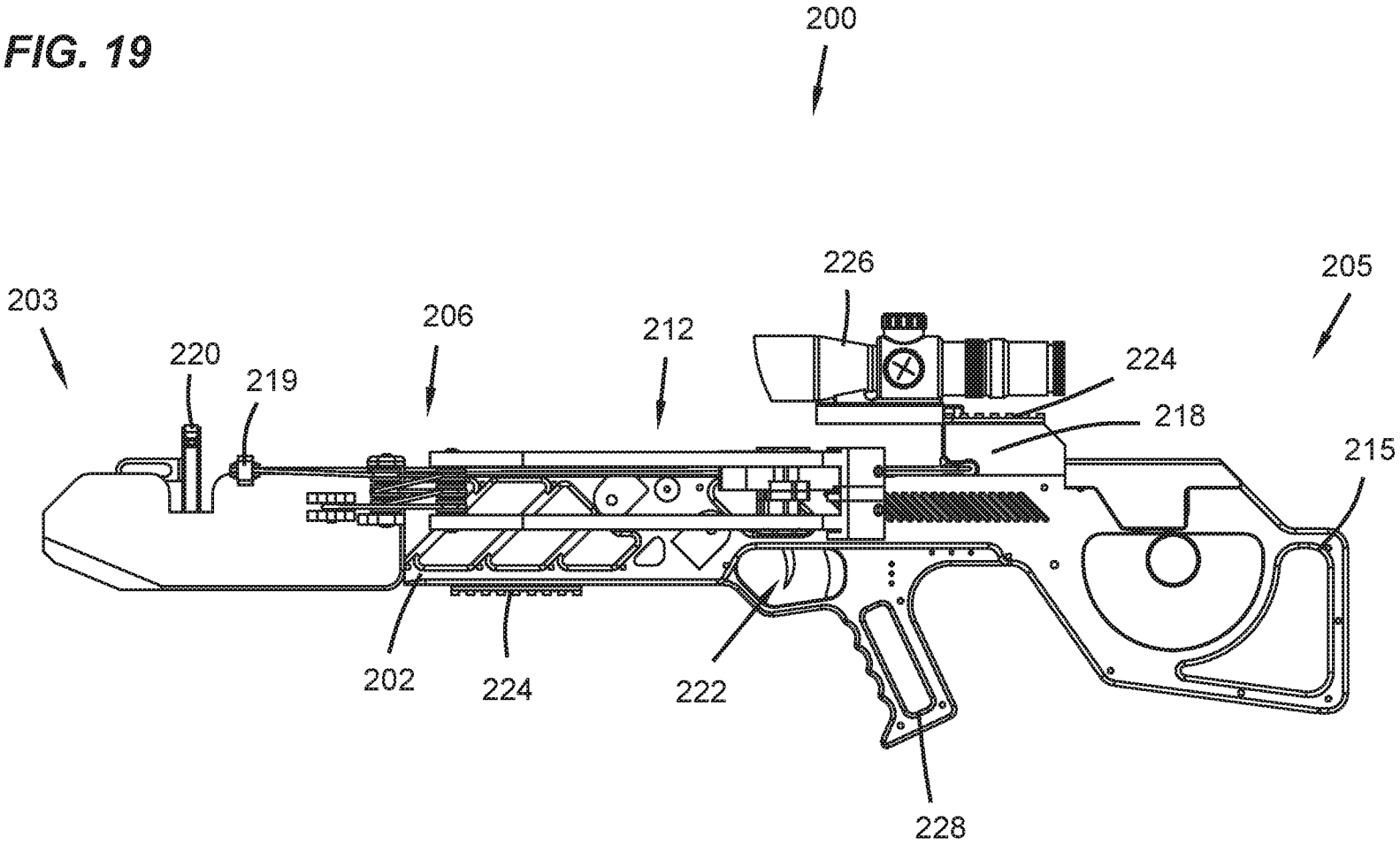
FIG. 19 is a left side view of the projectile launcher of FIG. 15 drawn.
Figure 21:
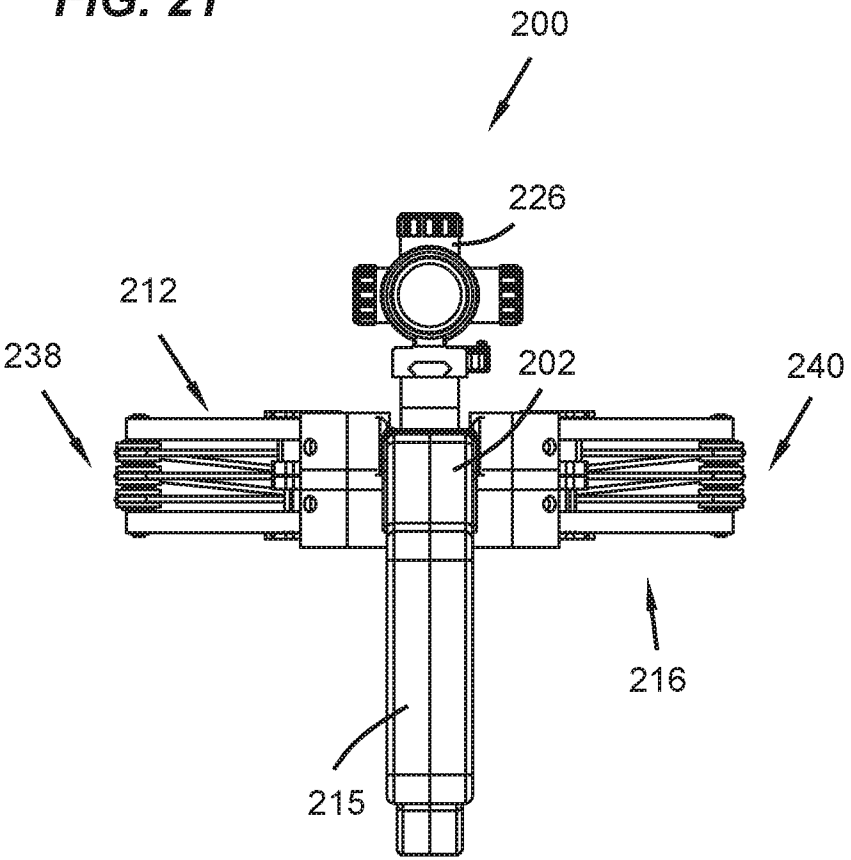
FIG. 21 is a rear side view of the projectile launcher of FIG. 15 undrawn.
Figure 20:
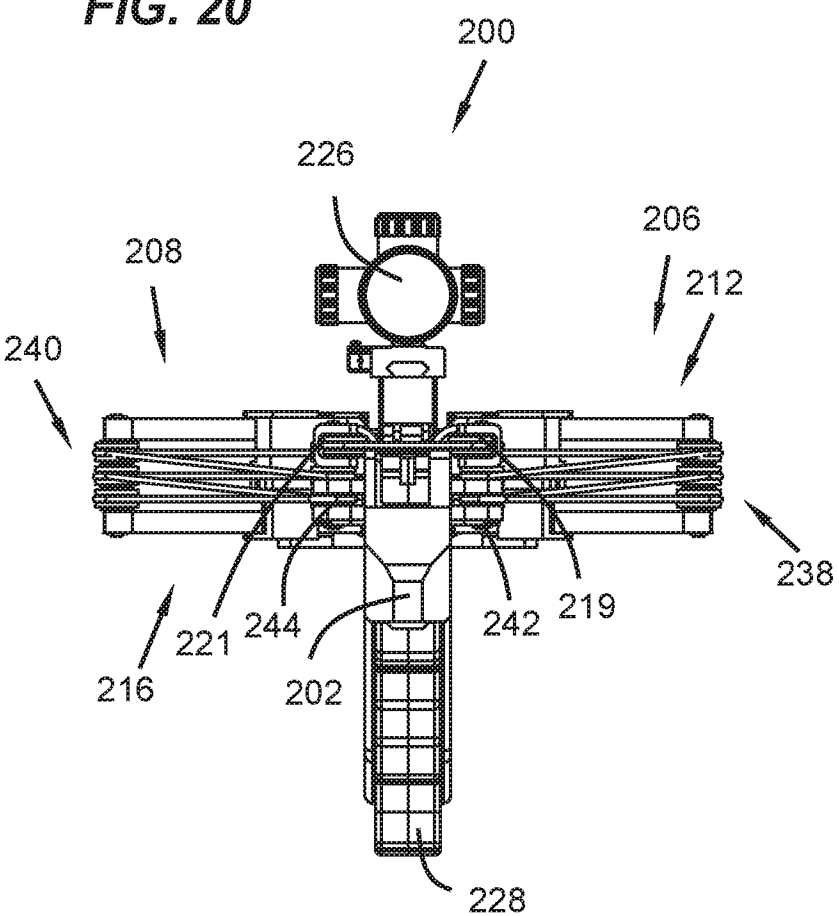
FIG. 20 is a front side view of the projectile launcher of FIG. 15 undrawn.
Figure 23:
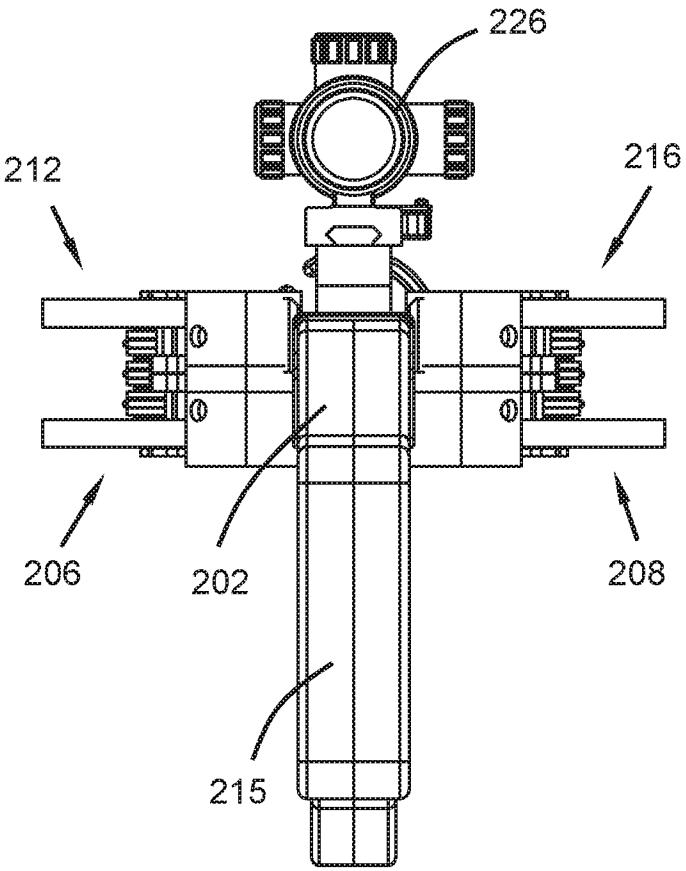
FIG. 23 is a rear side view of the projectile launcher of FIG. 15 drawn.
Figure 22:
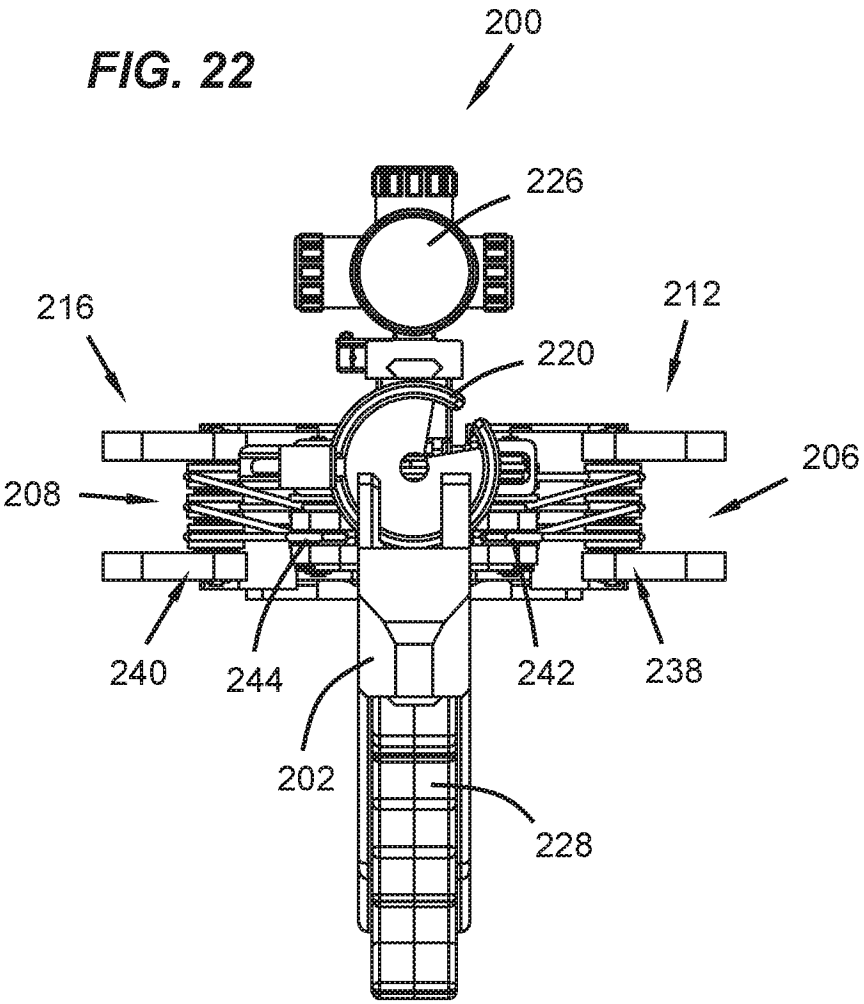
FIG. 22 is a front side view of the projectile launcher of FIG. 15 drawn.
Figure 24:
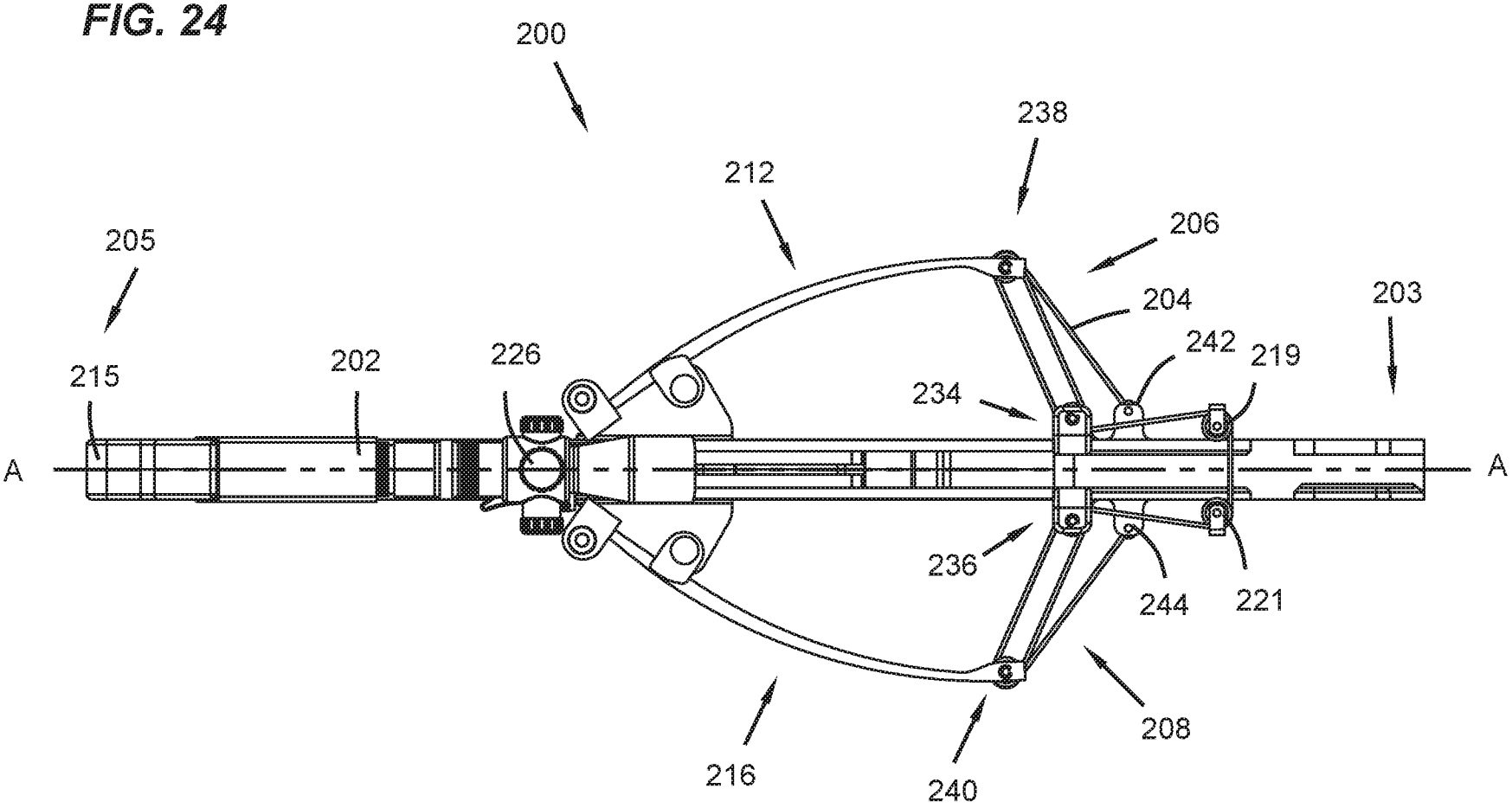
FIG. 24 is a top side view of the projectile launcher of FIG. 15 undrawn.
Figure 25:
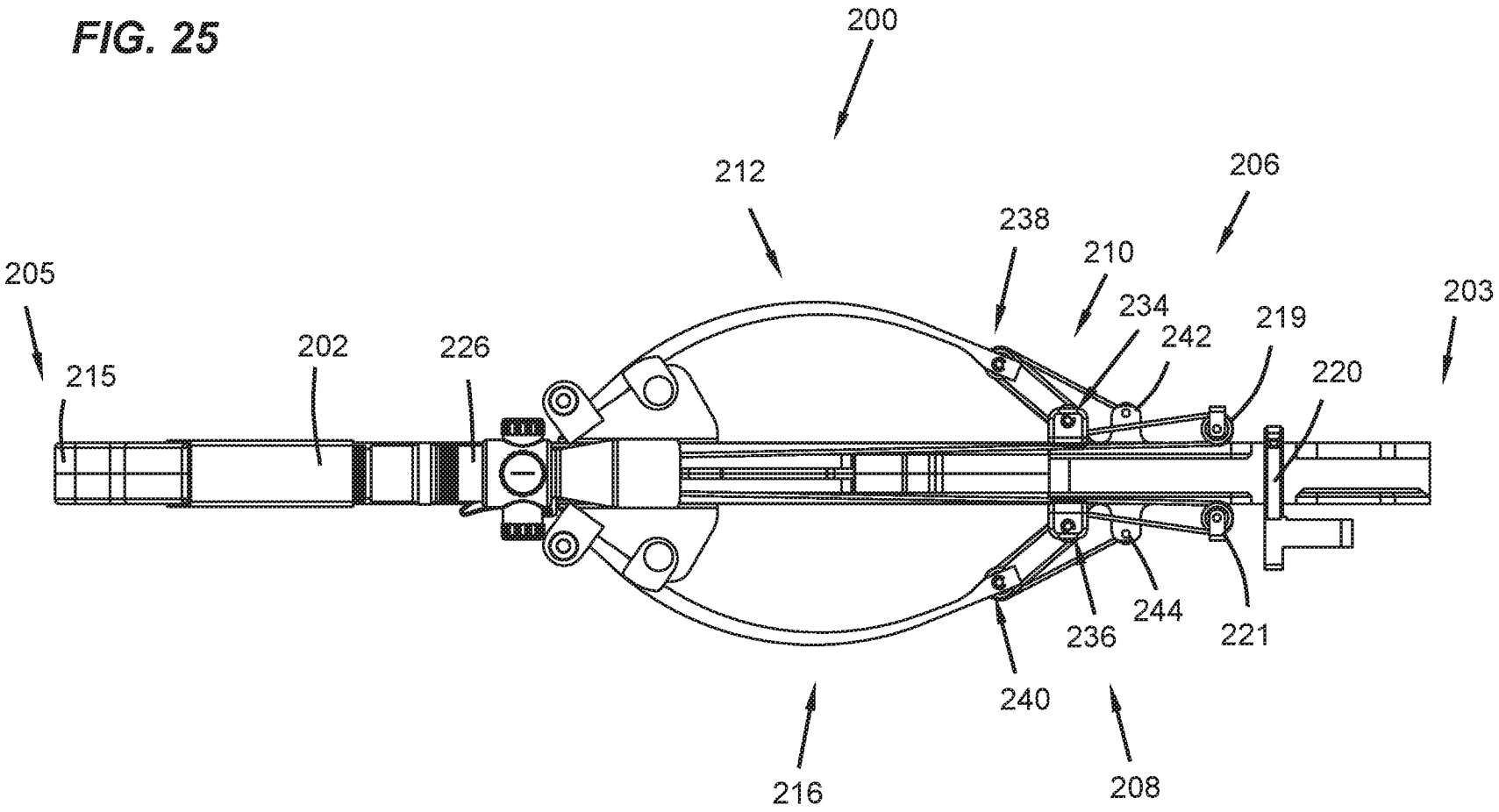
FIG. 25 is a top side view of the projectile launcher of FIG. 15 drawn.

FIG. 17 shows a rear perspective view of the projectile launcher 200 undrawn. FIGS. 18-19 show side views of the projectile launcher 200 undrawn. FIGS. 20-21 show front and rear views of the projectile launcher 200 undrawn. FIGS. 22-23 show front and rear views of the projectile launcher 200 drawn. FIG. 24 shows a top view of the projectile launcher 200 undrawn. FIG. 25 shows a top view of the projectile launcher 200 drawn.

As shown, the drawstring 204 is attached at a first mounting point 242 to frame 202, then routed within the first power group 206 before crossing the projectile axis A and being routed within the second power group 208 before being attached at a second mounting point 244 to the frame 202.

Figure 26:
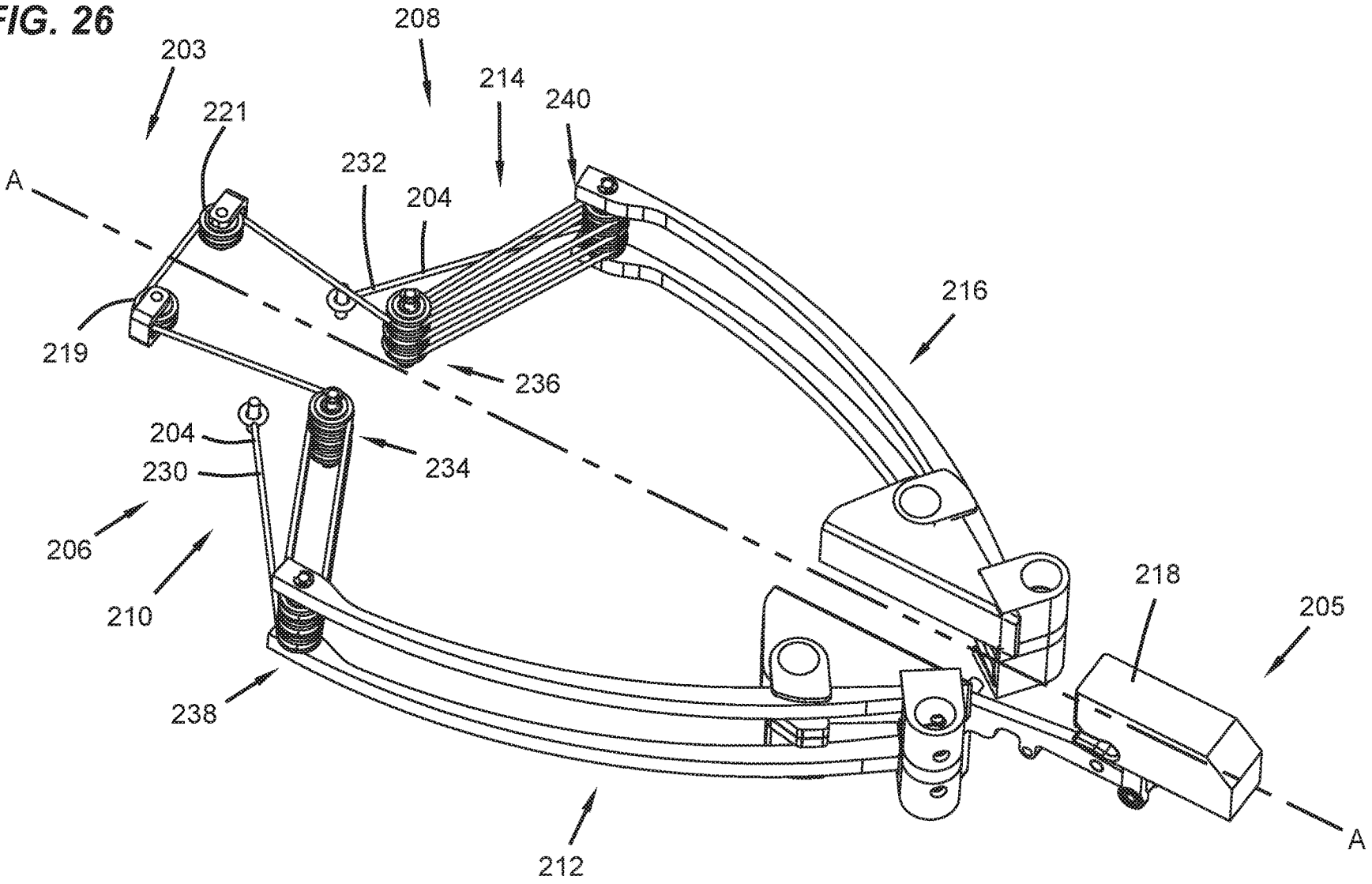
FIG. 26 is a left side rear perspective view of a portion of the projectile launcher of FIG. 15 in the undrawn position.
Figure 27:
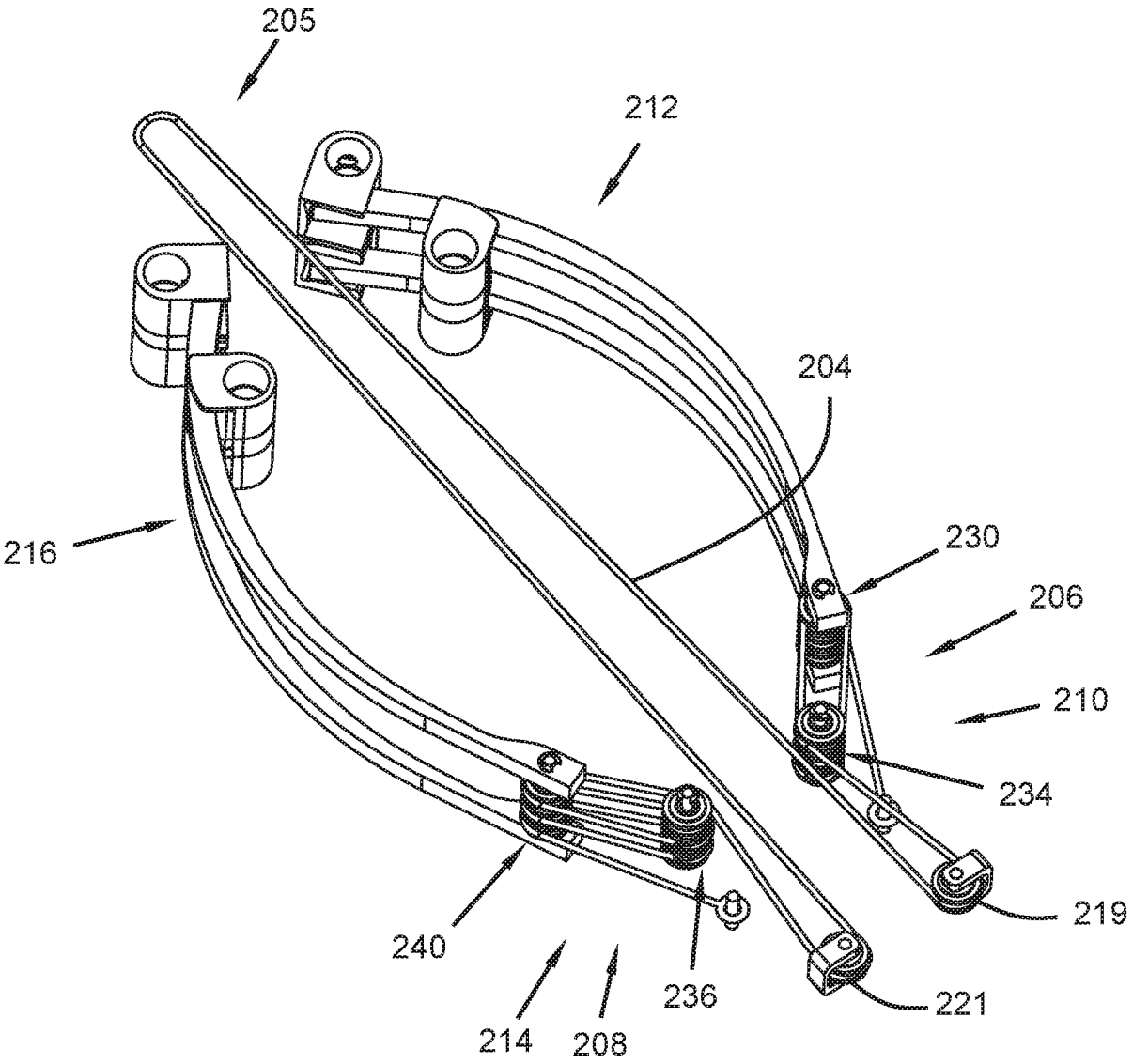
FIG. 27 is a left side rear perspective view of a portion of the projectile launcher of FIG. 15 in the drawn position.
Figures 28A, 28B, 28C, 28D, 28E, 28F, 28G, 28H, 28I:
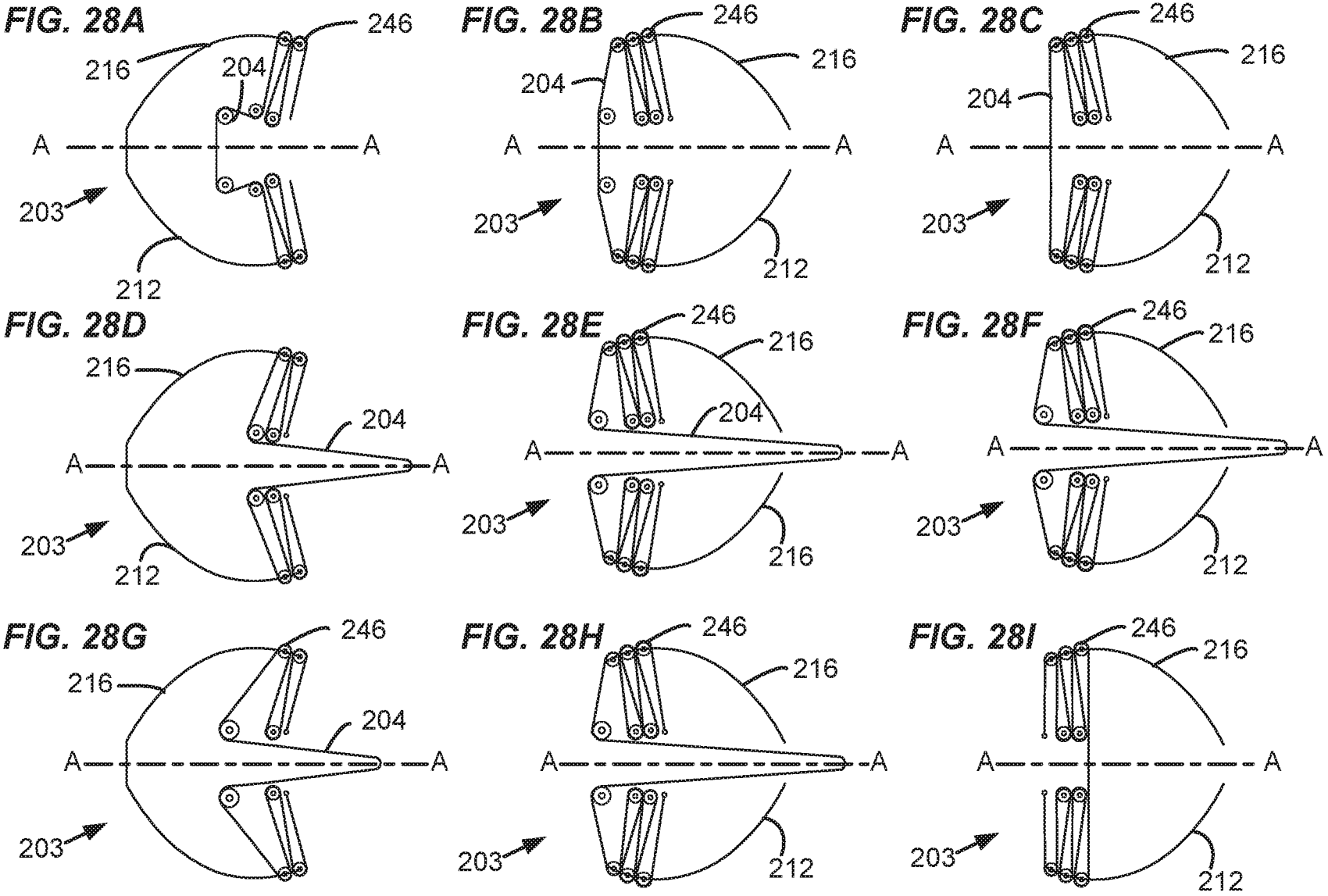
FIGS. 28*a*-28*i* depict schematic limb, drawstring, and pulley arrangements of the projectile launcher according to examples of the present disclosure.

FIG. 26 shows a portion of the projectile launcher 200 with the frame 202 removed and the drawstring 204 undrawn and routed within first and second power groups 206, 208 and the drawstring guides 219, 221. FIG. 27 shows a perspective view of the drawstring 204 drawn. Like projectile launcher 100, when moving from undrawn to drawn, the drawstring 204 moves to pull the limbs 212, 216 closer to the frame 202. Said another way, the drawstring 204 pulls first and second power group limb pulleys 238, 240 of the first and second power group drawstring pulleys 210, 214 toward first and second power group frame pulleys 234, 236 of the first and second power group drawstring pulleys 210, 214.

Single pulleys 246 are substantially similar to the pulleys 146 described above.

FIGS. 28*a*-28*i* show various limb, drawstring, and power group arrangements for the projectile launcher 200. While examples are shown using the projectile launcher 200, projectile launcher 100 can have similar configurations. As noted above, the projectile launcher 200 can have any number of different configurations, such as, but not limited to, the drawstring pulleys 210, 214 can be stacked on a single shaft (i.e., axle), the drawstring pulleys 210, 214 can be staggered along either the first/second flexible limbs 212, 216 or frame 202, the limbs 212, 216 can be forward, rearward, upward, downward, or sideward facing, and the drawstring guides 219, 221 can be positioned in front of (i.e., toward the front end 203 of the frame 202) or behind the drawstring pulleys 210, 214. In some examples, the drawstring pulleys 210, 214 function as the drawstring guides so as to guide the drawstring 204 across the projectile axis A. Additionally, the projectile launcher 200 can have a variety of different numbers of drawstring pulleys 210, 214 so as to reroute the drawstring 204 any number of times. Finally, while first and second ends 230, 232 of the drawstring 204 are shown as attachable to opposite sides of the frame 202, the first and second ends 230, 232 can also be attached to the first and second flexible limbs 212, 214.

Figure 29:
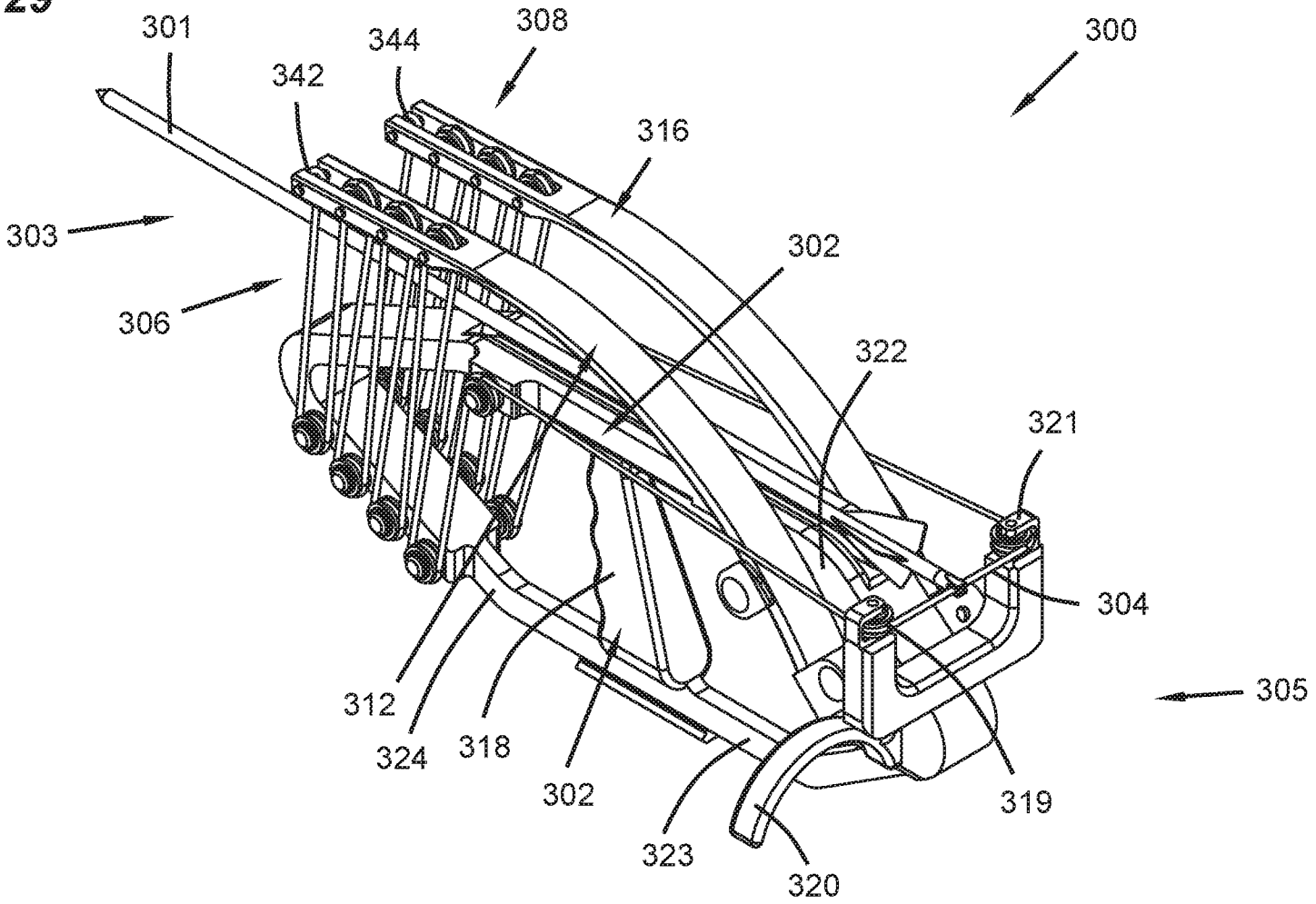
FIG. 29 is a right front perspective view of a projectile launcher according to the principles of the present disclosure; in particular
Figure 30:
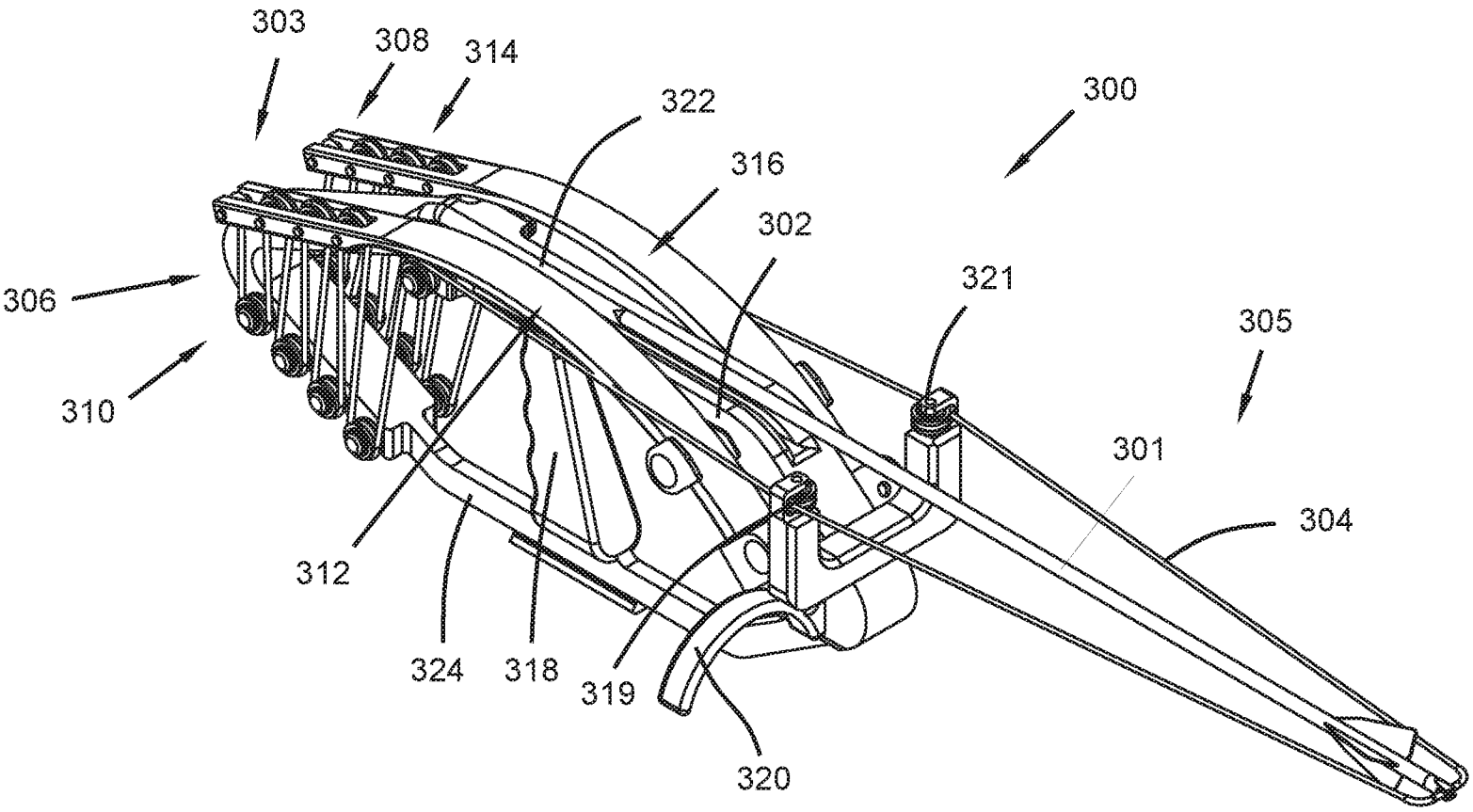
FIG. 30 is another right front perspective view of the projectile launcher of FIG. 29 drawn.

FIG. 29 shows a front perspective view of a projectile launcher 300 undrawn for firing a projectile 301. FIG. 30 shows a front perspective view of the projectile launcher 300 drawn. The projectile launcher 300 is substantially similar to the projectile launchers 100, 200 described above. The projectile launcher 300 includes upward and forward facing first and second limbs 312, 316. Additionally, the projectile launcher 300 includes a frame 302 that can be handled differently that the projectile launchers 100, 200 by the user. For example, the projectile launcher 300 is a slingshot that is configured to be held with an extended arm of a user, rather than the projectile launchers 200, 300 that are configured to be positioned against a shoulder of the user. Further, the projectile launcher 300 does not include a mechanism (i.e., a latch and trigger) to hold and release a drawstring 304 in the drawn position. Instead, because the projectile launcher 300 is a slingshot, the drawstring 304 is configured to be held drawn by the arm of the user until the user lets the drawstring 304 go when firing.

The projectile launcher 300 includes the frame 302, the drawstring 304, a first power group 306 including a plurality of first power group drawstring pulleys 310 and a first flexible limb 312, a second power group 308 including a plurality of second power group drawstring pulleys 314 and a second flexible limb 316, a first drawstring guide 319, and a second drawstring guide 321. The projectile launcher 300 also can include an accessory rail 325, a vertical grip 318, and a forearm brace 320.

Figure 31:
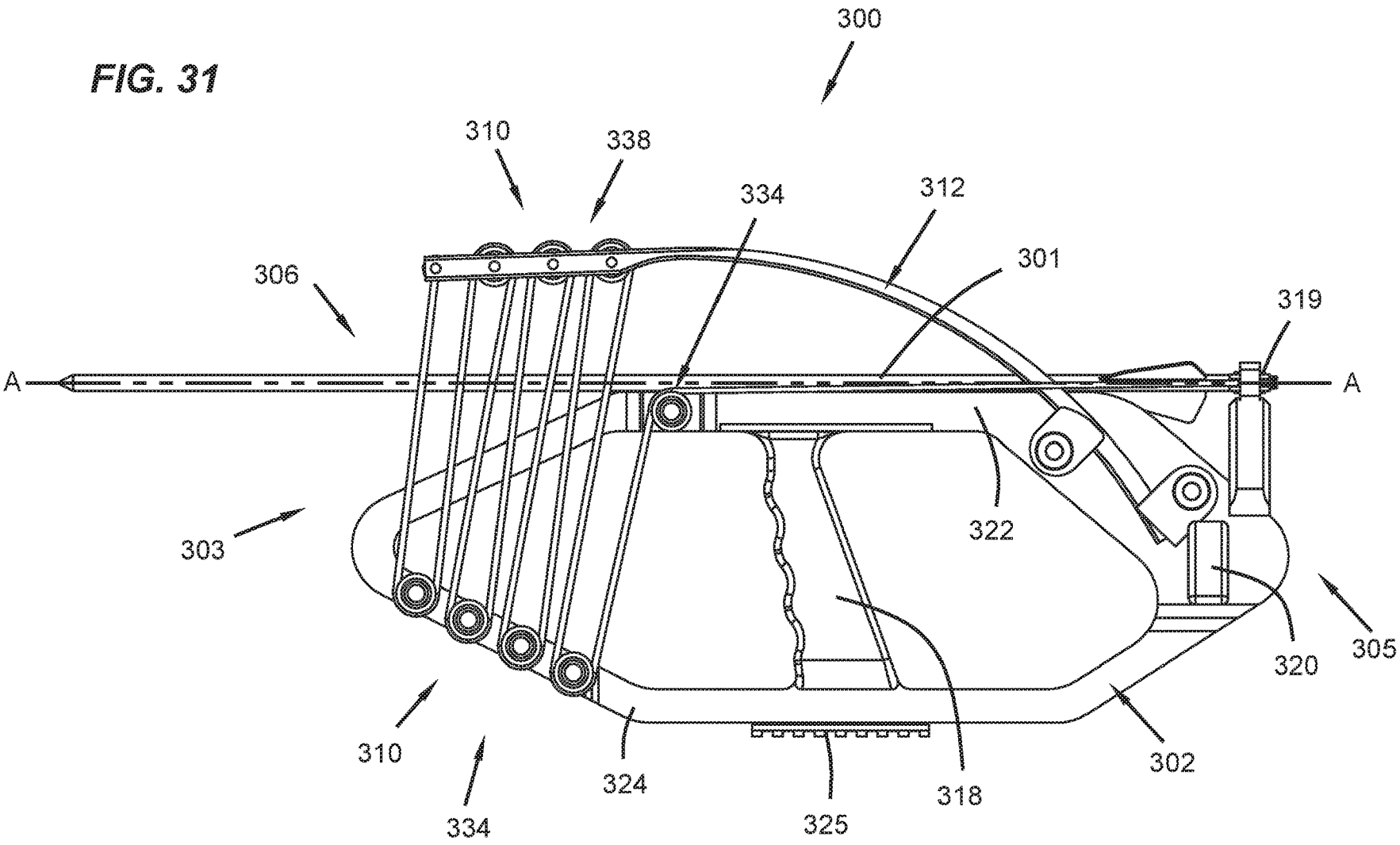
FIG. 31 is a right side view of the projectile launcher of FIG. 29 undrawn.
Figure 32:
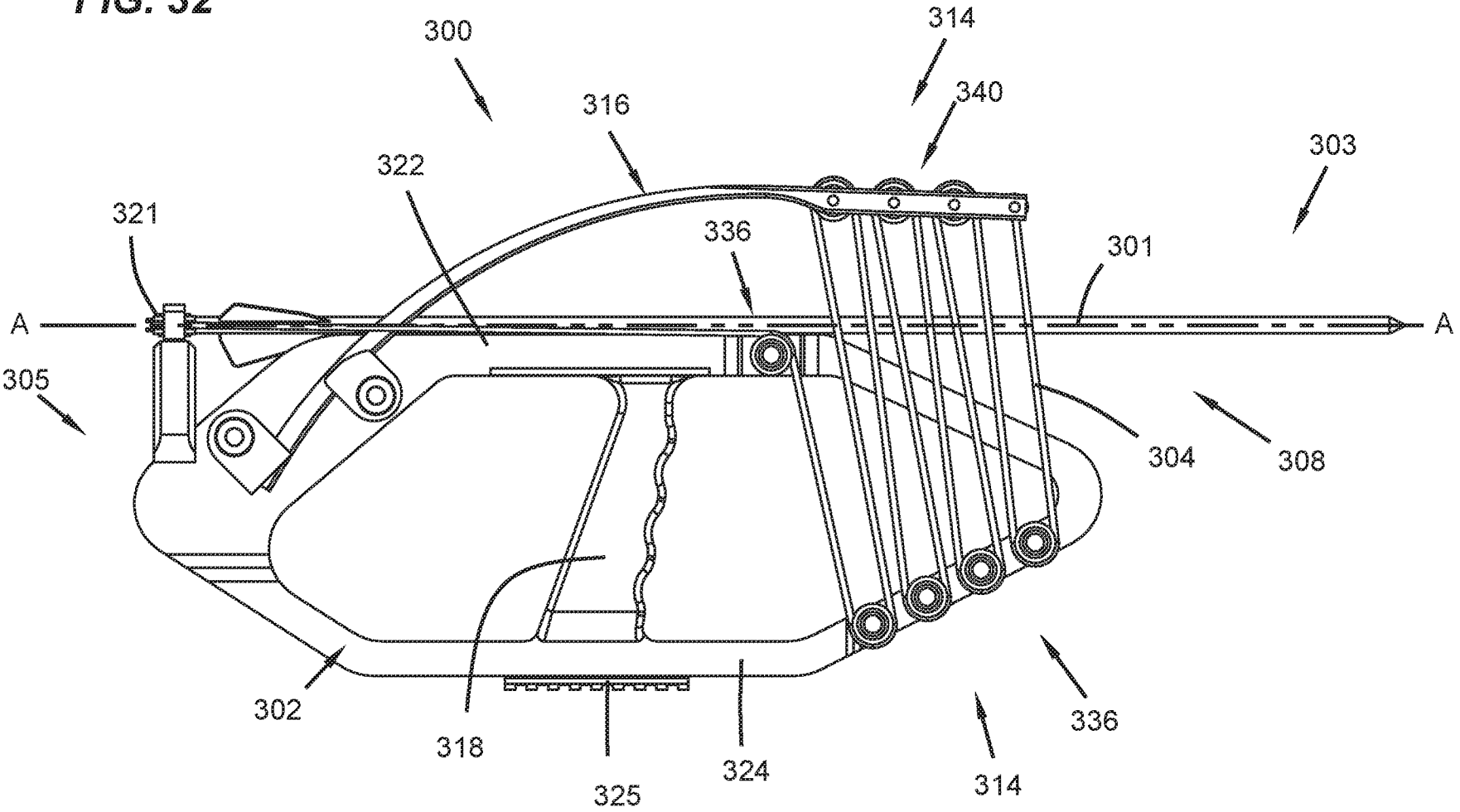
FIG. 32 is a left side view of the projectile launcher of FIG. 29 undrawn.
Figure 33:
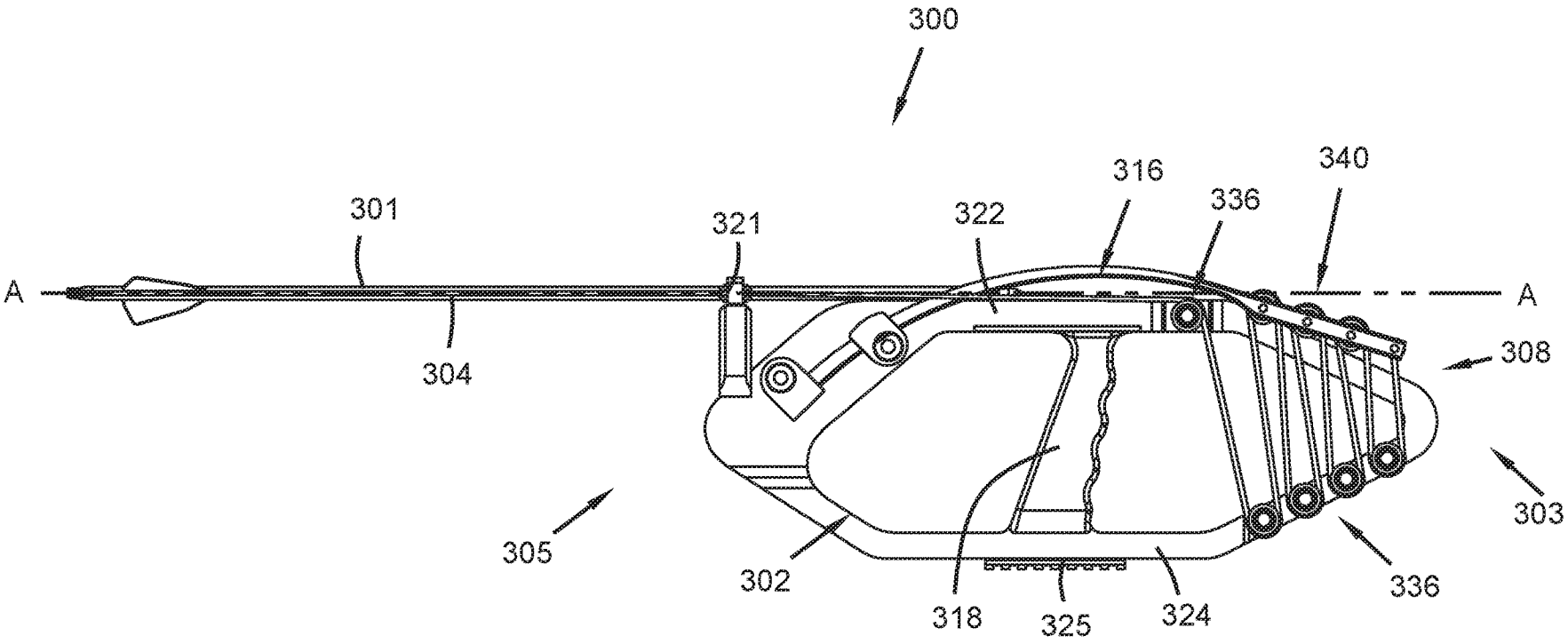
FIG. 33 is a front side view of the projectile launcher of FIG. 29 drawn.
Figure 34:
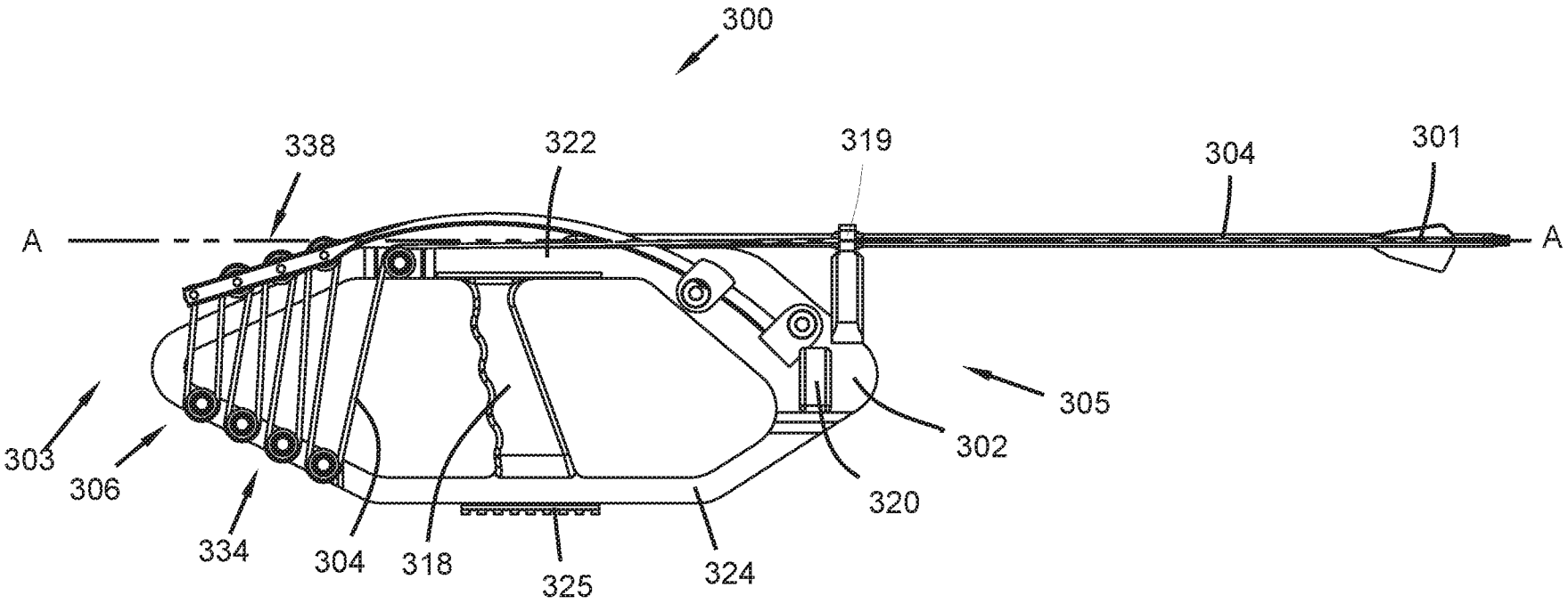
FIG. 34 is a rear side view of the projectile launcher of FIG. 29 drawn.
Figure 36:
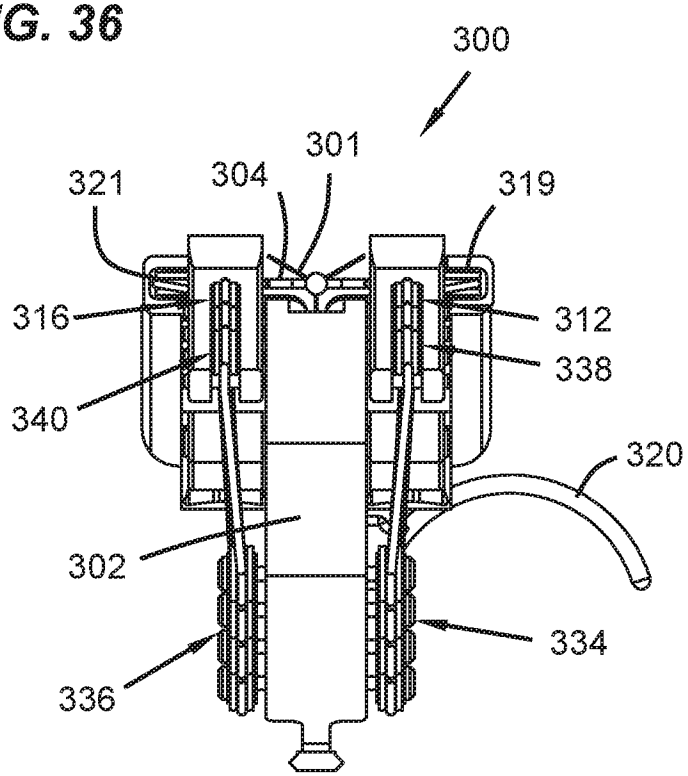
FIG. 36 is a rear side view of the projectile launcher of FIG. 29 drawn.
Figure 35:
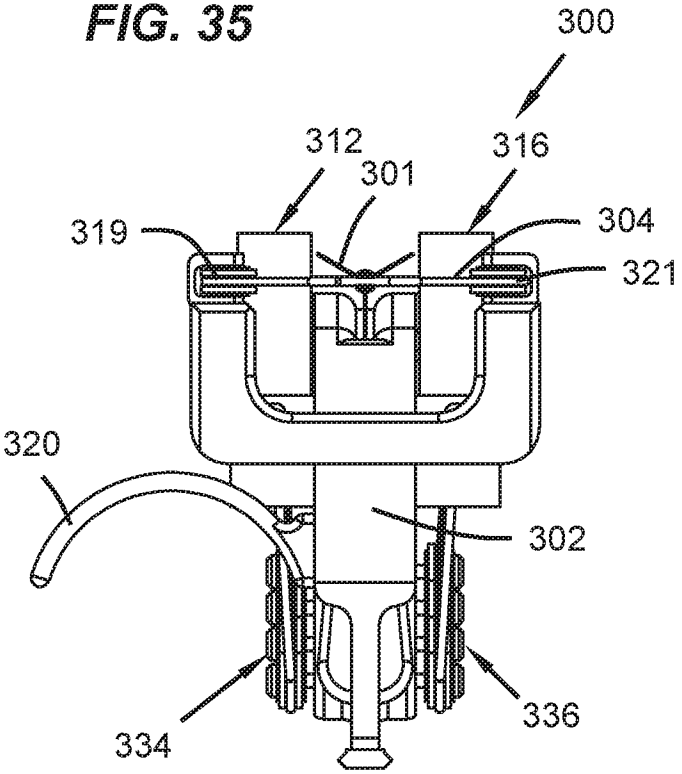
FIG. 35 is a front side view of the projectile launcher of FIG. 29 drawn.
Figure 37:
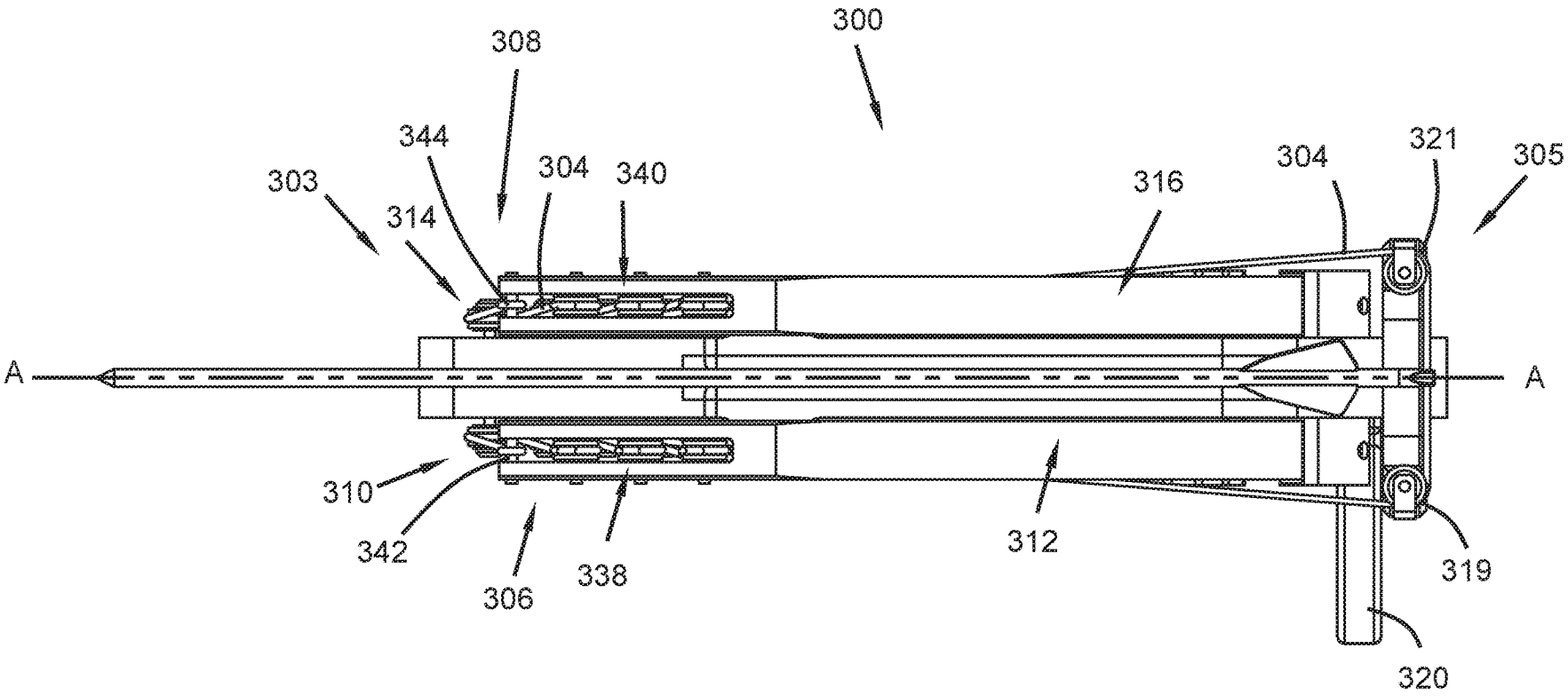
FIG. 37 is a top side view of the projectile launcher of FIG. 29 undrawn.
Figure 38:
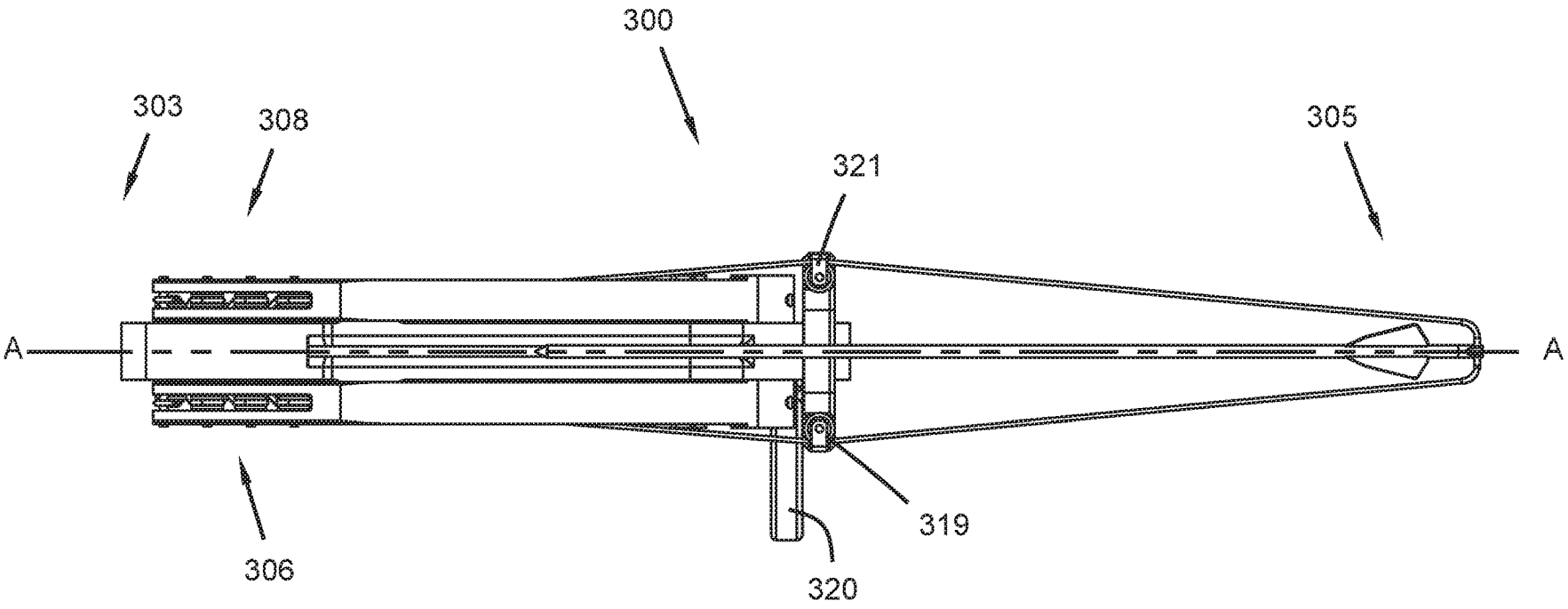
FIG. 38 is a top side view of the projectile launcher of FIG. 29 drawn.

FIGS. 31-32 show side views of the projectile launcher 300 undrawn. FIGS. 33-34 show side views of the projectile launcher 300 drawn. FIGS. 35-36 show front and rear views of the projectile launcher 300 undrawn. FIG. 37 shows a top view of the projectile launcher 300 undrawn. FIG. 38 shows a top view of the projectile launcher 300 drawn.

The frame 302 includes an upper member 322 and a lower member 324, each generally extending in the direction of the projectile axis A. The vertical grip 318 extends between the upper and lower members 322, 324. In some examples, the vertical grip 318 is a pistol grip. In some examples, the vertical grip 318 is adjustable relative to the upper and lower members 322, 324 so as to position the vertical grip 318 more toward a front or a rear end 303, 305 of the frame 302.

As shown, the drawstring 304 is attached at a first mounting point 342 to the first limb 312, then routed within the first power group 306 before crossing the projectile axis A and being routed within the second power group 308 before being attached at a second mounting point 344 to the second limb 316.

In some examples, the forearm brace 320 is connected to the frame 302 adjacent the rear end 305. The forearm brace 320 is configured to stabilize the slingshot using a user's arm. In some examples, the forearm brace 320 is downwardly curved so as to fit over a user's forearm, In some examples, the forearm brace 320 includes a strap to be secured to the user's forearm. In some examples, the forearm brace 320 is constructed of a rigid material. In some examples, the forearm brace 320 extends from a side 323 of the frame 302. In some examples, the forearm brace 320 is detachable from the frame 302. In some examples, the forearm brace 320 is integral with the frame 302.

The frame 302 can be constructed of a composite, wood, metal, or like material. In some examples, the frame 302 is a singular unibody component. In other examples, the frame 302 has a multiple-piece construction. In some examples, the frame 302 is configured to include a variety of different mounting points, such as the accessory rail 325, for various module accessories such as flashlights, sighting accessories, or other attachments.

The drawstring 304, in some examples, is coupled to the flexible limbs 312, 316 and the frame 302. In some examples, first and second ends 330, 332 of the drawstring 304 are attached at the first and second mounting points 342, 344 positioned on the first and second flexible limbs 312, 316.

The first power group 306 includes the plurality of first power group drawstring pulleys 310 and the first flexible limb 312. The second power group 308 includes the plurality of second power group drawstring pulleys 314 and the second flexible limb 316.

Like the first and second power group drawstring pulleys 110/114, 210/214, described above, the first and second power group drawstring pulleys 310, 314 reroute the drawstring 304 to aid in reducing the draw weight of the drawstring 304. For every drawstring pulley 310, 314 that reroutes the drawstring 304, the force that is required to draw the drawstring, thereby simultaneously pulling the flexible limbs 312, 316 closer the frame 302, is reduced. Therefore, a variety of different numbers of pulleys 310, 314 can be utilized. Specifically, the frame 302 can include first and second power group frame pulleys 334, 336 mounted thereto and the limbs 312, 316 can include first and second power group limb pulleys 338, 340 mounted thereto. As shown, the power group drawstring pulleys 310, 314 are staggered along the frame 302 and first and second limbs 312, 314. While three pulleys 346 are shown positioned in the first and second power group limb pulleys 338, 340, and five pulleys 346 are positioned in the first and second power group frame pulleys 334, 336, it is considered within the scope of the present disclosure that the first and second power group frame pulleys 334, 336 and first and second power group limb pulleys 338, 340 can include any number of pulleys 346. For example, the drawstring 104 can attached to frame 302 and the first power group limb pulleys 338 can include more pulleys than the first power group frame pulleys 334.

In the depicted example, the power group drawstring pulleys 310, 314 are each positioned around an axis Y that are each parallel with one another.

Figure 39:
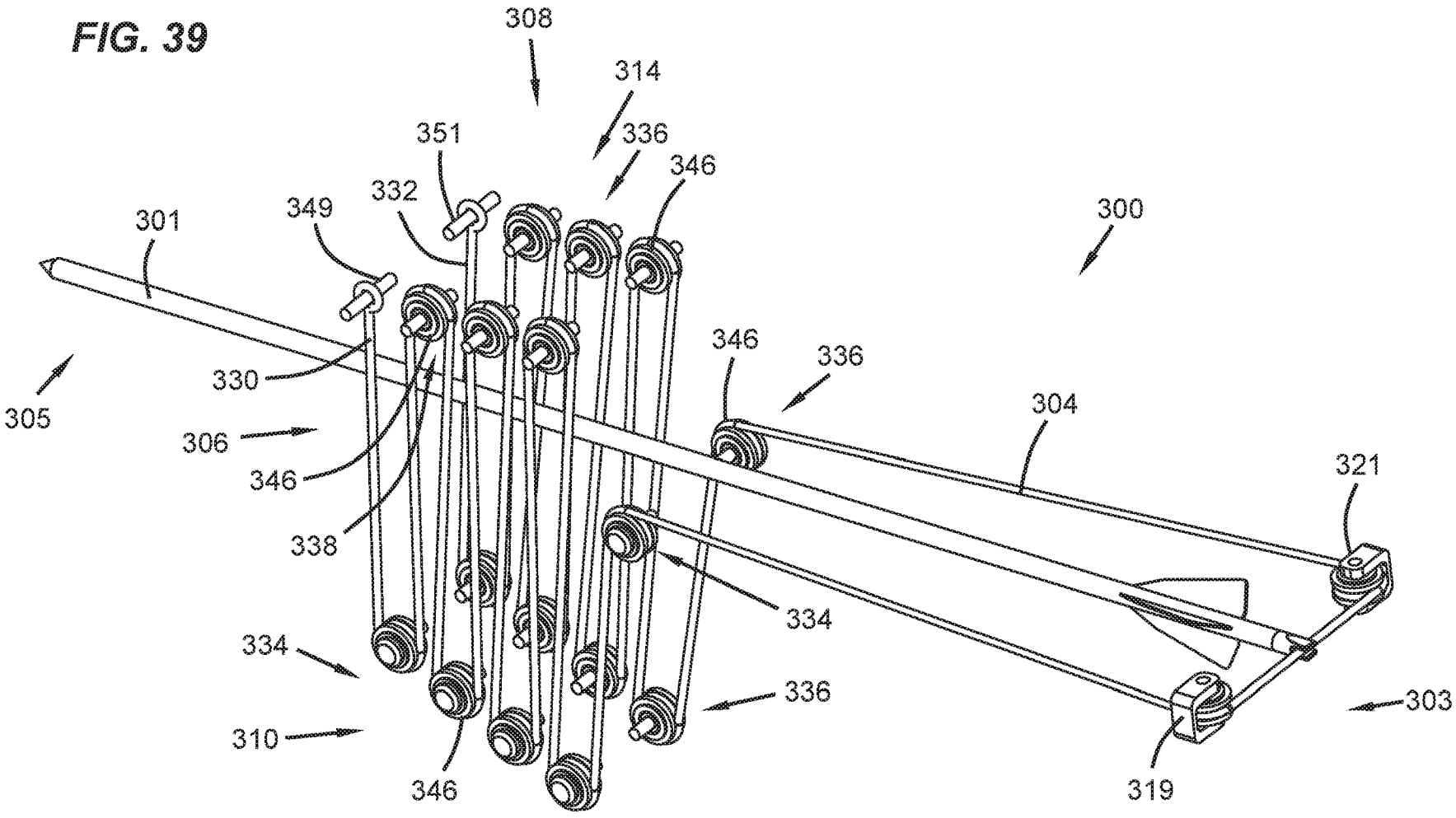
FIG. 39 is a left side rear perspective view of a portion of the projectile launcher of FIG. 29 in the undrawn position.
Figure 40:
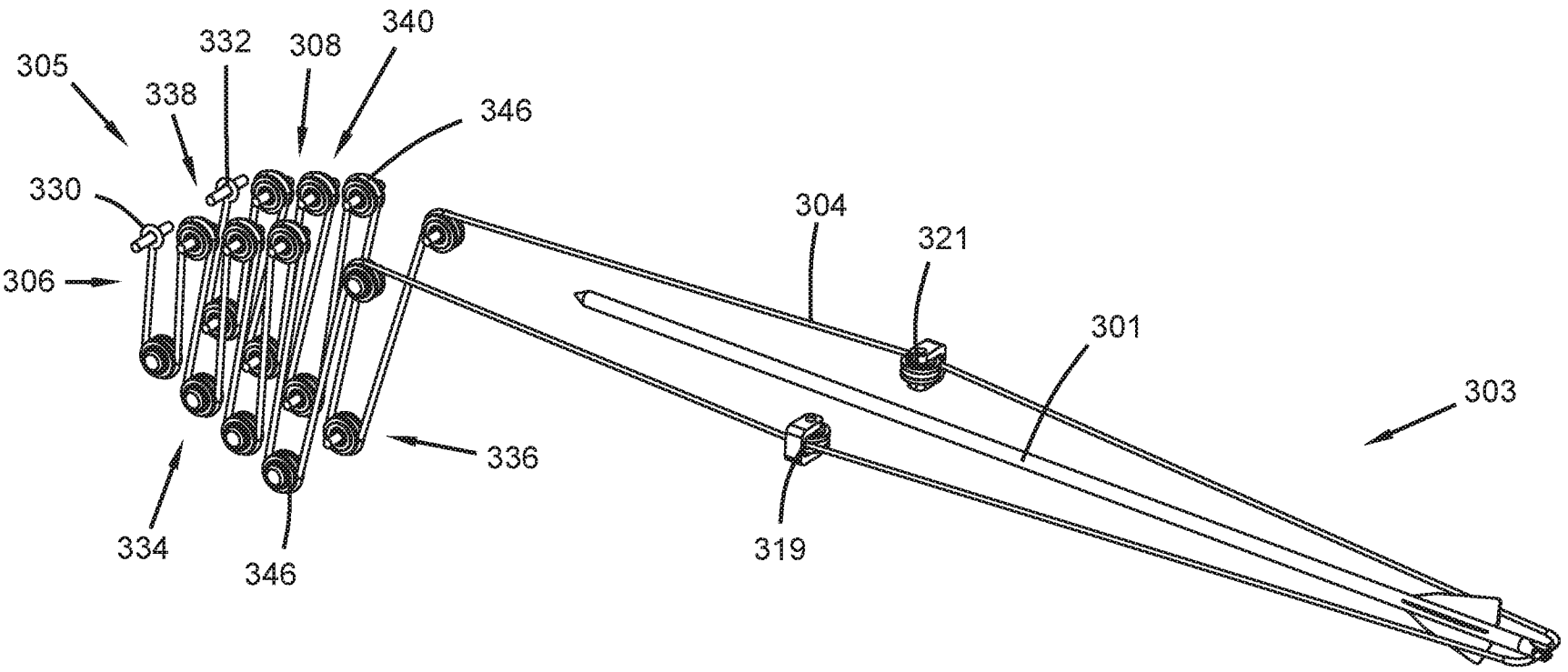
FIG. 40 is a left side rear perspective view of a portion of the projectile launcher of FIG. 29 in the drawn position.

FIG. 39 shows a portion of the projectile launcher 300 with the frame 302 and limbs 310, 316 removed and the drawstring 304 undrawn and routed within first and second power groups 306, 308 and the drawstring guides 319, 321. FIG. 40 shows a perspective view of the drawstring 304 drawn. When moving from undrawn to drawn, the drawstring 304 pulls the first and second power group limb pulleys 338, 340 toward the first and second power group frame pulleys 334, 336.

As shown ends 330, 332 of the drawstring 304 are attached to shafts 349,351. In the depicted example, the shafts 349, 351 are attached to the first and second limbs 312, 316 at first and second mounting points 342, 344.

Figure 41:
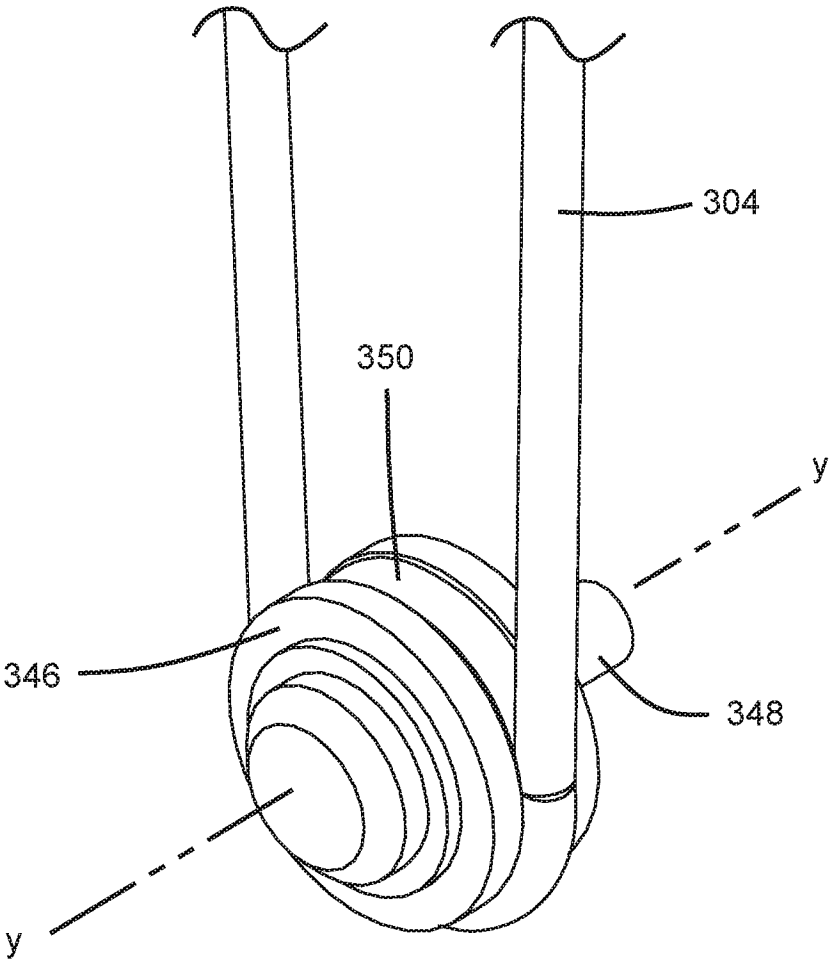
FIG. 41 is a perspective view of a single pulley of the projectile launcher of FIG. 29.

FIG. 41 shows a perspective view of a single pulley 346. The single pulley 346 can be a single pulley from the first or second power group drawstring pulleys 310, 314. Thus, the following description applies to any of the pulleys of the projectile launcher 300.

As shown, a single pulley 346 arranged around the central axis Y around a single shaft 348. In some examples, each the pulleys 346 is positioned around a separate shaft. In some examples, the pulley 346 is rotatable around the shaft 348. In some examples, the pulley 346 includes a bearing/bushing between the pulley 346 and shaft 348 to allow the pulley 346 to freely rotate around the shaft 348. In some examples, the pulley 346 is fixed to the shaft 348 and or/the drawstring 304. In some examples, the shaft 348 is mounted to the limbs or frame via bearings to allow the shaft 348 to rotate relative to the frame or limbs.

Like pulley 146 described above, the pulley 346 includes a groove 350 sized and shaped to receive the drawstring 304. In some examples, the groove 350 can be positioned around a circumference of the pulley 346. In some examples, the pulley 346 can include multiple grooves 350. In some examples, the pulley 346 is constructed from a low friction material to allow the drawstring 104 to move effortlessly relative thereto. In such an examples, the pulley 346 can be fixed relative to the shaft 348. In some examples, the pulley 346 is constructed in a way to allow the drawstring 304 to grip and rotate the pulley 346 as the drawstring 304 is moved between the undrawn and drawn position. For example, the groove 350 can be textured, e.g., lined with a high grip material or mechanical feature to grab the drawstring 304. While the pulley 346 is shown as circular, the pulley 346 can also have other shapes, such as lobe-shaped.

Figure 42:
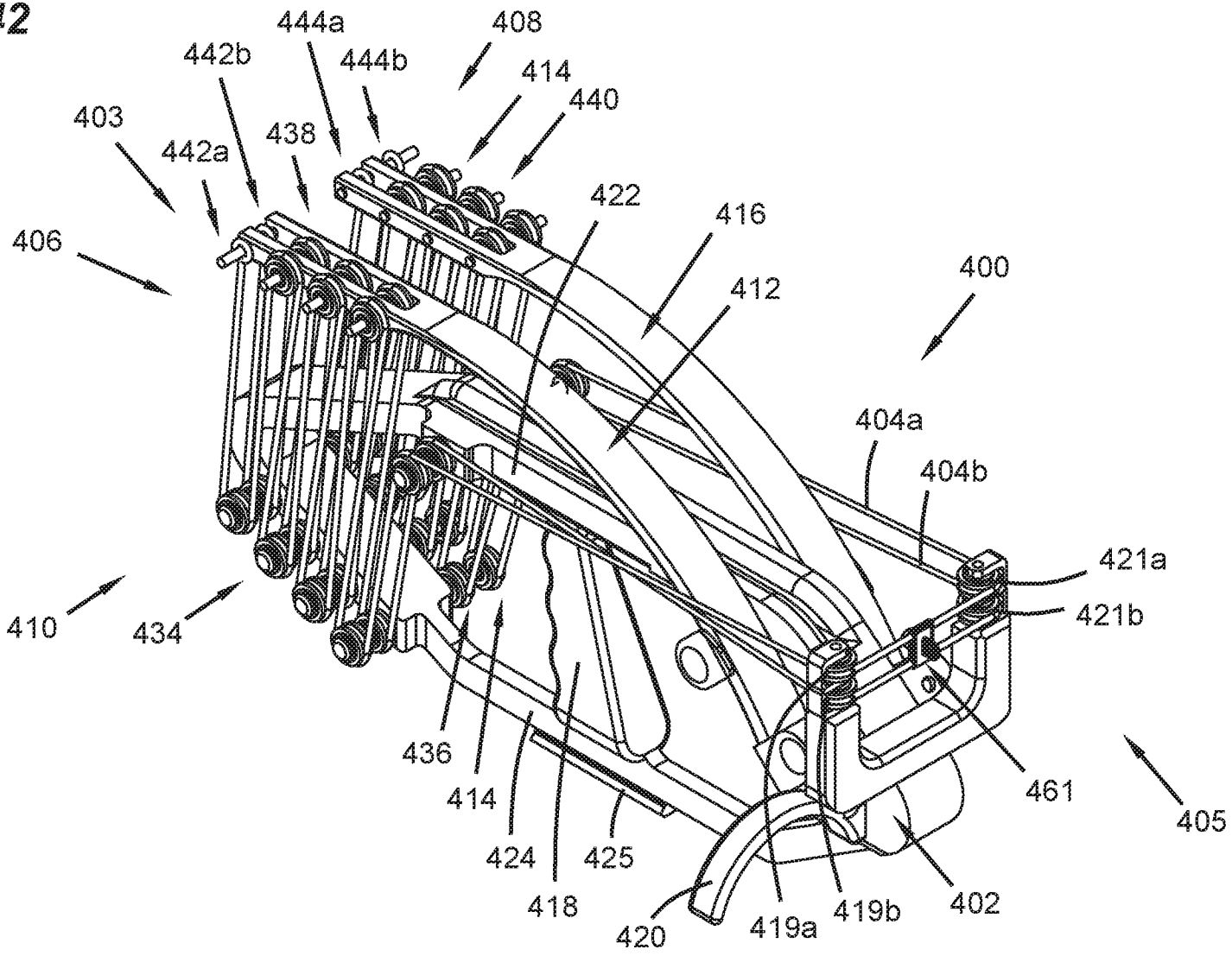
FIG. 42 is a right front perspective view of a projectile launcher according to the principles of the present disclosure; in particular

FIG. 42 shows a rear perspective view of a projectile launcher 400 undrawn. The projectile launcher 400 is substantially similar to the projectile launchers 100, 200, 300 described above. Specifically, the projectile launcher 400 is a slingshot that is configured to be held with an extended arm of a user, like projectile launcher 300, rather than the projectile launchers 100, 200 that are configured to be positioned against a shoulder of the user. The projectile launcher 400 includes dual drawstrings 404*a*, 404*b*.

The projectile launcher 400 includes a frame 402 that includes an upper member 422 and a lower member 424, a first drawstring 404*a*, a second drawstring 404*b*, a first power group 406 including a plurality of first power group drawstring pulleys 410 and a first flexible limb 412, a second power group 408 including a plurality of second power group drawstring pulleys 414 and a second flexible limb 416, a first set drawstring guides 419*a*/419*b*, and a second set drawstring guides 421*a*/421*b*. The projectile launcher 400 also can include an accessory rail 425, a vertical grip 418, and a forearm brace 420.

Figure 43:
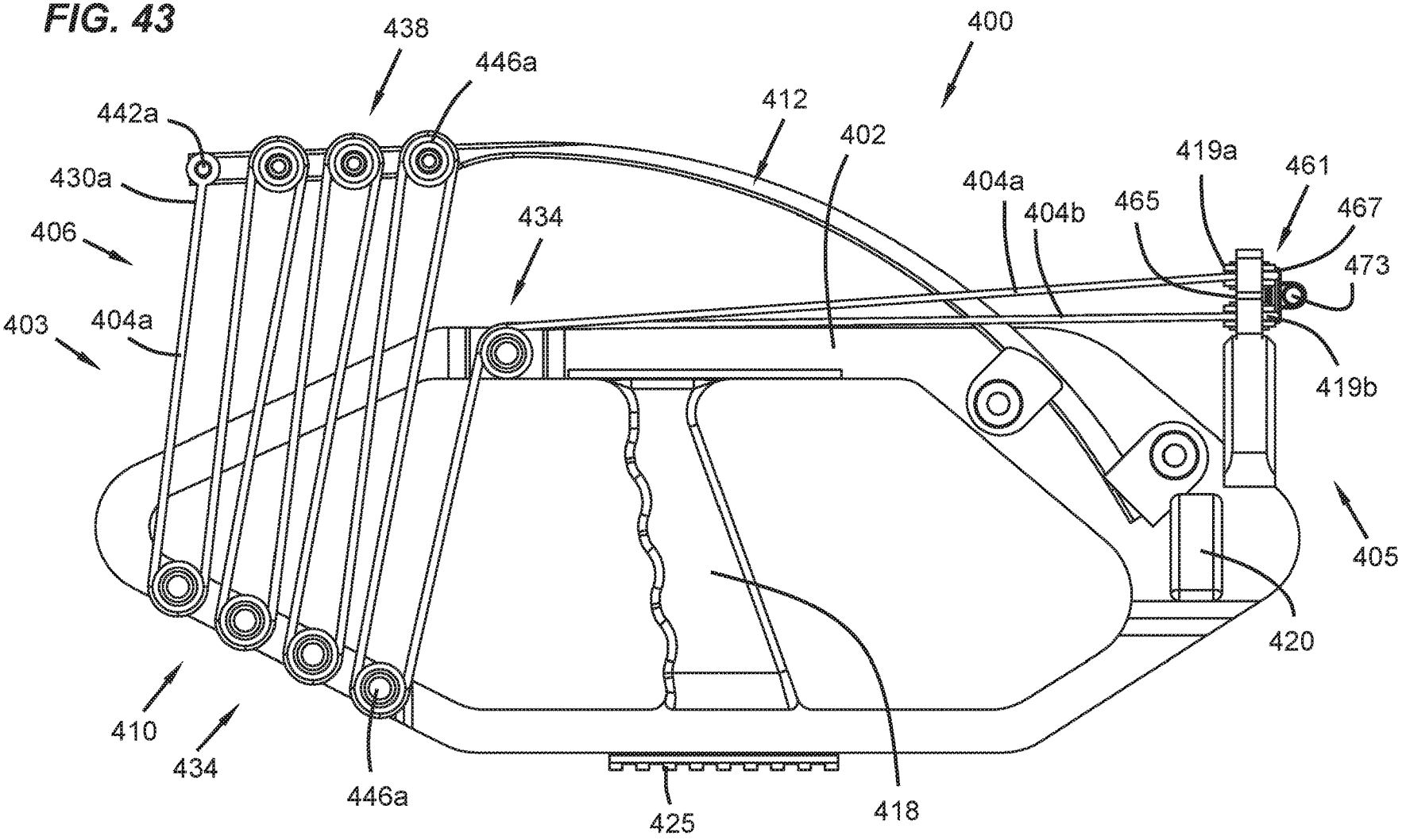
FIG. 43 is a left side view of the projectile launcher of FIG. 42 undrawn.
Figure 44:
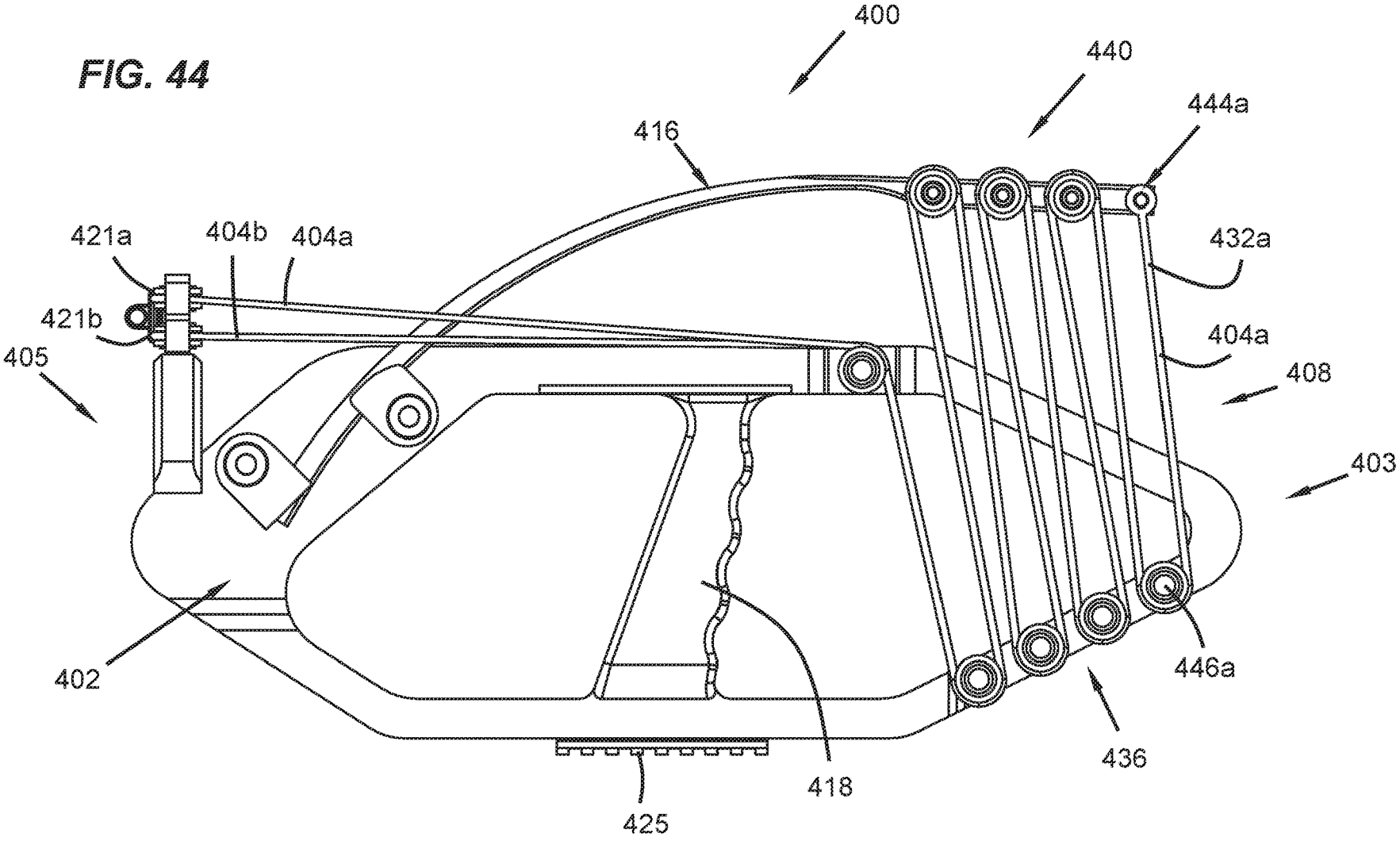
FIG. 44 is a right side view of the projectile launcher of FIG. 42 undrawn.
Figure 46:
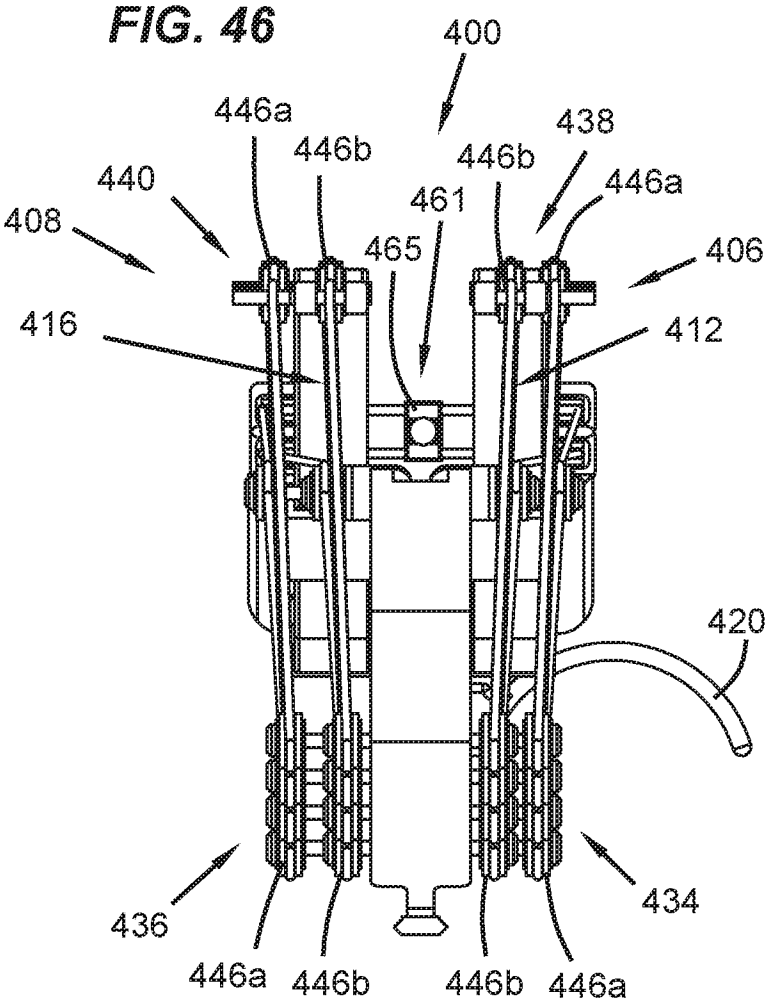
FIG. 46 is a rear side view of the projectile launcher of FIG. 42 undrawn.
Figure 45:
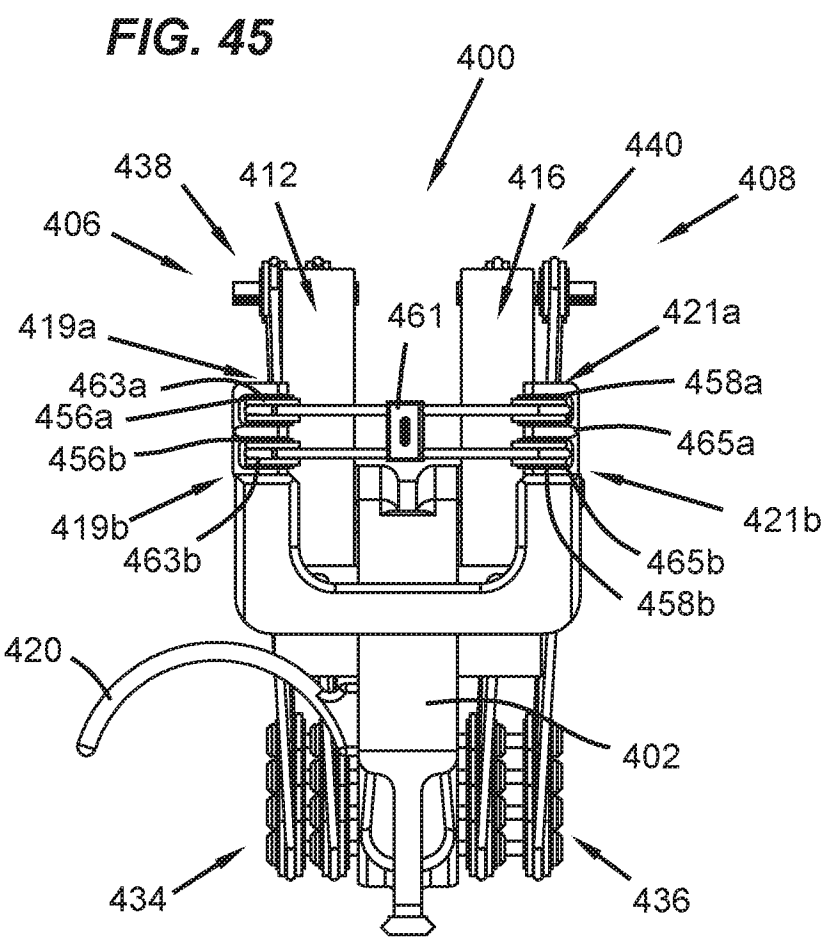
FIG. 45 is a front side view of the projectile launcher of FIG. 42 undrawn.
Figure 47:
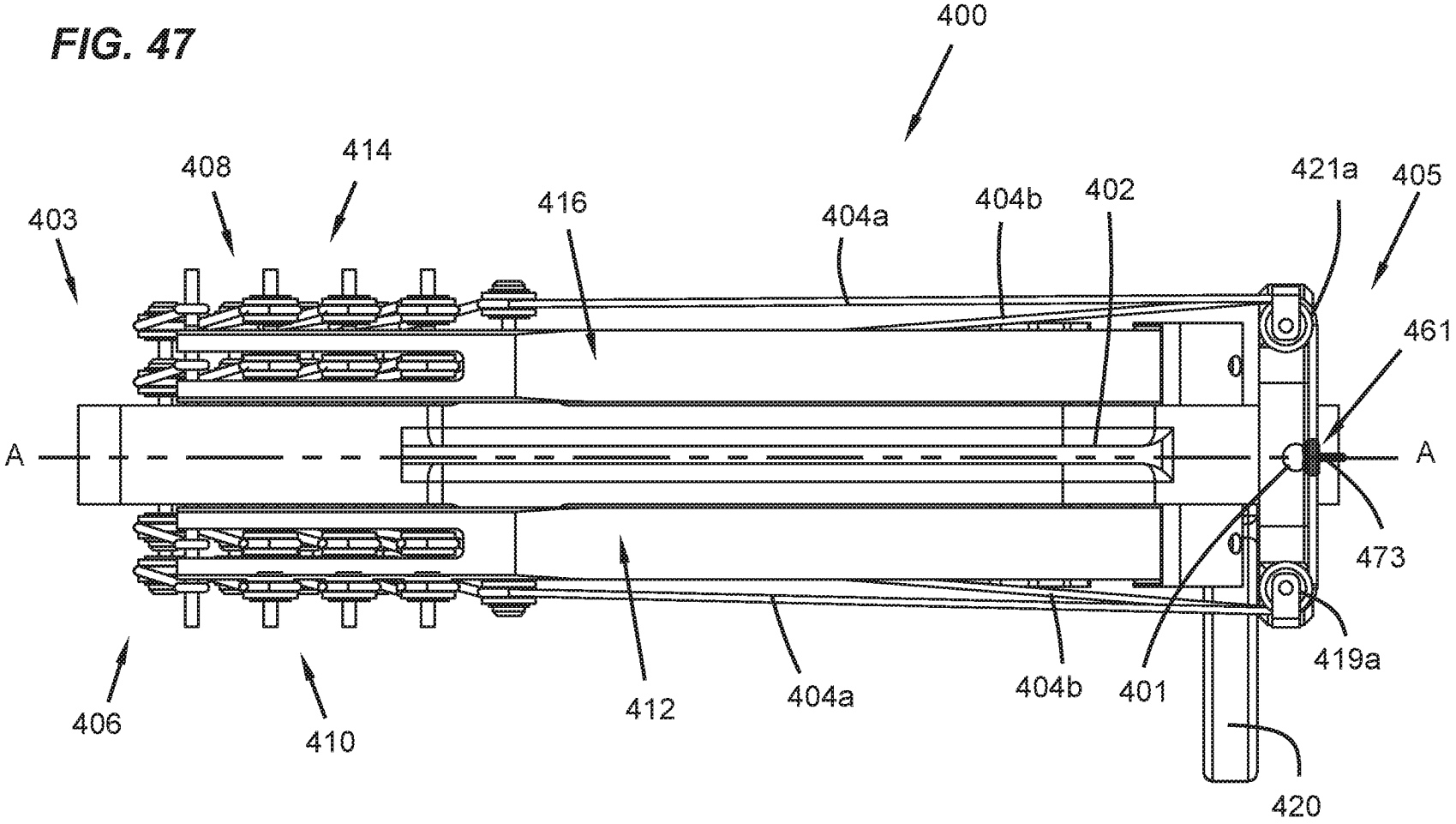
FIG. 47 is a top side view of the projectile launcher of FIG. 42 undrawn.

FIGS. 43-44 show side views of the projectile launcher 400 undrawn. FIGS. 45-46 show front and rear views of the projectile launcher 400 undrawn. FIG. 47 shows a top view of the projectile launcher 400 undrawn.

The first and second drawstrings 404*a*, 404*b* are substantially similar. The second drawstring 404*b* is routed immediately adjacent the first drawstring 404*a*. In some examples, the drawstrings 404*a*, 404*b* are configured to move together. The projectile launcher 400 includes a shot assembly 461 attached to the first and second drawstrings 404*a*, 404*b*. The shot assembly 461 is configured to receive and retain the projectile. In some examples, the shot assembly 461 is configured to retain a round projectile.

In the depicted example, the first and second drawstring 404*a*, 404*b* can be routed around separate pulleys 446*a*, 446*b*, within the first and second power group drawstring pulleys 410, 414. In some examples, the first and second drawstrings 404*a*, 404*b* can be routed around the same pulley. In some examples, the first and second drawstrings 404*a*, 404*b* can be routed in separate grooves 450*a*, 450*b* in each pulley 446*a*, 446*b*.

As shown, the drawstrings 404*a*, 404*b* are attached at first mounting points 442*a*, 442*b* to the first limb 412*a*, 412*b* at ends 430*a*, 430*b* then routed within the first power group 406 before crossing the projectile axis A and being routed within the second power group 408 before being attached at second mounting points 444*a*, 444*b* at ends 432*a*, 432B to the second limb 416.

In some examples, the first and second drawstring guides 419*a*/419*b*, 421*a*/421*b* include similar separate grooves 463*a*/463*b*, 465*a*/465*b* to separate and guide the drawstrings 404*a*, 406*b*. In some examples, the projectile launcher 400 can include only a pair of drawstring guides 419 and 421, each guiding the drawstrings 404*a*, 404*b* on a single guide, In some examples, the first and second drawstring guides 419*a*/419*b*, 421*a*/421*b* each include a pair of pulley wheels 456*a*/456*b*, 458*a*/458*b*, one for each drawstring 404*a*, 404*b*

The shot assembly 461 includes a front side 465 and an opposite rear side 467. In some examples, the front side 465 faces a front side 403 of the frame 402. In some examples, the front side 465 includes a pouch. In some examples, the front side 465 includes a magnet to retain a metal projectile. In some examples, the front side 465 includes both the pouch and the magnet. In some examples, the front side 465 includes a mechanical retention means to hold a projectile that is non-magnetic. The rear side 467 faces a rear side 405 of the frame 402. In some examples, the rear side 467 includes an engagement point 473. The engagement point 473 can be grasped by the user by way of fingers or a tool to aid in drawing the drawstrings 404*a*, 404*b* to the drawn position. In some examples, the engagement point 473 is a loop.

Figure 48:
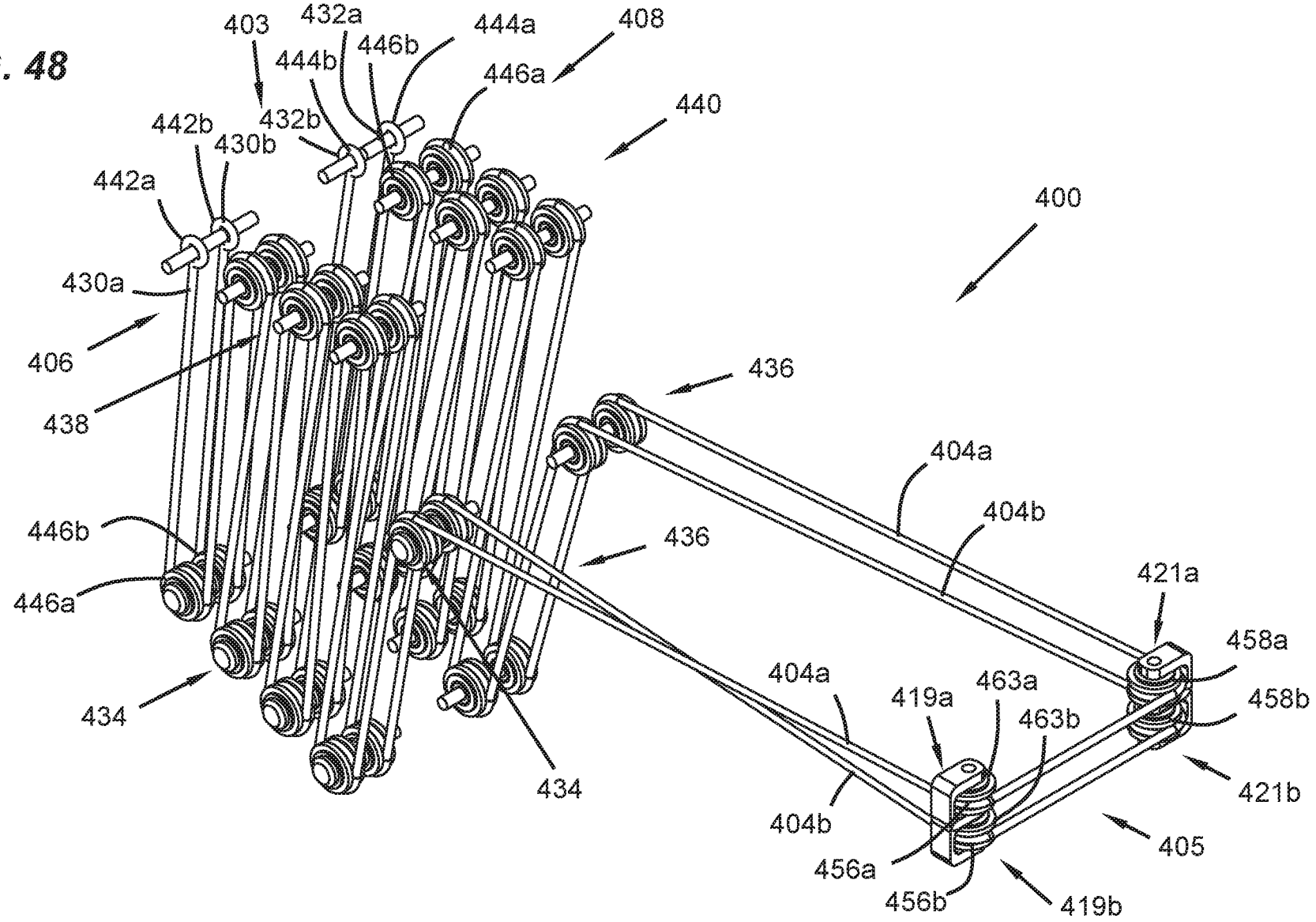
FIG. 48 is a left side rear perspective view of a portion of the projectile launcher of FIG. 42 in the undrawn position.

FIG. 48 shows a portion of the projectile launcher 400 for firing a projectile 401 with the frame 402, limbs 412, 416, and shot assembly 461 removed and the drawstring 404 undrawn and routed within first and second power groups 406, 408 and the drawstring guides 419, 421. When moving from undrawn to drawn, the drawstring 404 pulls first and second power group limb pulleys 438, 440 toward first and second power group frame pulleys 434, 436.

Figure 49:
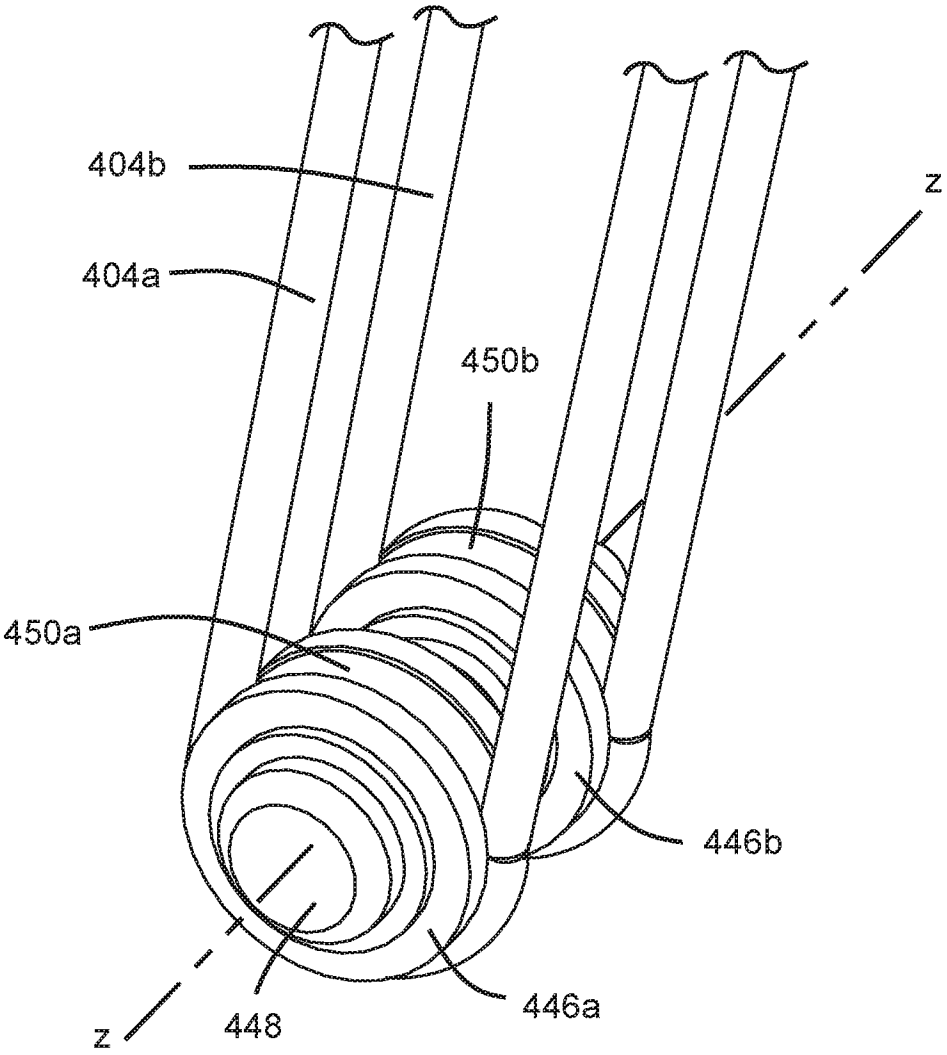
FIG. 49 is a perspective view of a plurality of pulleys of the projectile launcher of FIG. 42.

FIG. 49 shows a perspective view of the pulleys 446*a*, 446*b*. The pulleys 446*a*, 446*b* can be from the first or second power group drawstring pulleys 410, 414. Thus, the following description applies any of the pulleys of the projectile launcher 400. In some examples, the pulley 446*a* is configured to receive and guide drawstring 404*a* while the pulley 446*b* is configured to receive and guide drawstring 404*b*. In some examples, the pulleys 446*a*, 446*b* are connected to one another.

As shown, pulleys 446*a*, 446*b* are arranged around a central axis Z around a single shaft 448. In some examples, each pulley 446*a*, 446*b* is positioned around a separate shaft. In some examples, the pulleys 446*a*, 446*b* are rotatable around the shaft 448. In some examples, the pulleys 446*a*, 446*b* each include a bearing/bushing between the pulleys 446*a*, 446*b* and shaft 448 to allow the pulleys 446*a*, 446*b* to freely rotate around the shaft 448. In some examples, the pulleys 446*a*, 446*b* are fixed to the shaft 448 and or/the drawstrings 404*a*, 404*b*. In some examples, the shaft 448 is mounted to the limbs or frame via bearings to allow the shaft 448 to rotate relative to the frame or limbs.

Like the pulleys 146, 246, 346 described above, each of the pulleys 446*a*, 446*b* includes the grooves 450*a*, 450*b* sized and shaped to receive the drawstrings 404*a*, 404*b*. In some examples, the grooves 450*a*, 450*b* can be positioned around a circumference of the pulleys 446*a*, 446*b*. In some examples, each pulley 446*a*, 446*b* can include multiple grooves. In some examples, each pulley 446*a*, 446*b* is constructed from a low friction material to allow the drawstrings 404*a*, 404*b* to move effortlessly relative thereto. In such an examples, the pulleys 446*a*, 446*b* can be fixed relative to the shaft 448. In some examples, the pulleys 446*a*, 446*b* are constructed in a way to allow the drawstrings 404*a*, 404*b* to grip and rotate the pulleys 446*a*, 446*b* as the drawstrings 404*a*, 404*b* are moved between the undrawn and drawn position. For example, the grooves 450*a*, 450*b* can be textured, e.g., lined with a high grip material or mechanical feature to grab the drawstrings 404*a*, 404*b*. While the pulleys 446*a*, 446*b* are shown as circular, the pulleys 446*a*, 446*b* can also have other shapes, such as lobe-shaped.

EXAMPLES

Illustrative examples of the projectile launcher disclosed herein are provided below. An embodiment of the projectile launcher may include any one or more, and any combination of, the examples described below.

In Example 1, a projectile launcher includes a frame having a horizontal projectile plane at a top side in which a projectile axis is positioned. The projectile moves within the horizontal projectile plane and along the projectile axis during firing and arming of the projectile launcher, and the projectile is fired from a front end of the frame. The projectile launcher includes a first flexible limb and a second flexible limb, each first and second limb having a first end attached to the frame and a second end, wherein the first and second flexible limbs are in an unloaded position when the projectile launcher is undrawn and in a loaded position when the projectile launcher is drawn. The projectile launcher includes a first power group at a first frame side, the first power group including a plurality of first power group drawstring pulleys and the first flexible limb, at least one of the plurality of first power group drawstring pulleys being attached to the frame and at least one of the plurality of the first power group drawstring pulleys being attached to the first flexible limb. The projectile launcher further includes a second power group at a second frame side, the second power group including a plurality of second power group drawstring pulleys and the second flexible limb, at least one of the plurality of second power group drawstring pulleys being attached to the frame and at least one of the plurality of second power group drawstring pulleys being attached to the second flexible limb. The projectile launcher further includes a drawstring having first and a second drawstring ends, the drawstring traveling at least partially perpendicular to the projectile axis between the first and the second drawstring ends, the drawstring being movable within the projectile plane during firing and arming of the projectile launcher. The drawstring is routed at least partially around the plurality of first power group drawstring pulleys at the first frame side, and the drawstring is routed at least partially around the plurality of second power group drawstring pulleys at the second frame side. The plurality of first and second power group drawstring pulleys are configured to reduce a draw weight of the drawstring.

In Example 2, the projectile launcher of Example 1 is modified in that the projectile launcher is a crossbow and the frame includes a stock being positioned at a rear end of the frame, the stock being configured to be positioned against an operator's shoulder.

In Example 3, the projectile launcher of Example 2 is modified to further include a projectile rest positioned at the front end of the frame, the projectile rest being configured to at least partially support the projectile.

In Example 4, the projectile launcher of Example 2 is modified to further include a latch configured to interface with the drawstring, the latch being configured to receive and retain a drawstring at the rear end of the frame.

In Example 5, the projectile launcher of Example 1 is modified in that the projectile launcher is a slingshot having a vertical grip.

In Example 6, the projectile launcher of Example 5 is modified in that the frame includes an upper member and a lower member, wherein the vertical grip is positioned between the upper and lower members.

In Example 7, the projectile launcher of Example 1 is modified in that the plurality of first power group drawstring pulleys include a plurality of first frame pulleys attached to the frame, wherein the plurality of first frame pulleys are coaxial with one another. The first power group further includes a plurality of first limb pulleys attached to the first flexible limb, wherein the plurality of first limb pulleys are coaxial with one another. The plurality of second power group drawstring pulleys include a plurality of second frame pulleys attached to the frame, wherein the plurality of second frame pulleys are coaxial with one another. The second power group further includes a plurality of second limb pulleys attached to the second flexible limb, wherein the plurality of second limb pulleys are coaxial with one another.

In Example 8, the projectile launcher of Example 1 is modified in that each of the plurality of first power group drawstring pulleys are rotatable around a pulley axis, wherein the axes of the plurality of first power group drawstring pulleys are parallel with one another. Each of the plurality of second power group drawstring pulleys are rotatable around a pulley axis, wherein the axes of the plurality of second power group drawstring pulleys are parallel with one another.

In Example 9, a projectile launcher includes a frame defining a horizontal projectile plane at a top side in which a projectile axis is positioned. A projectile moves within the horizontal projectile plane and along the projectile axis during firing and arming of the projectile launcher, and the projectile is fired from a front end of the frame. The projectile launcher includes a first power group at a first frame side, the first power group including a plurality of first power group drawstring pulleys, at least one of the plurality of first power group drawstring pulleys being attached to the frame, wherein a drawstring is configured to be routed at least partially around the first power group drawstring pulleys. The projectile launcher further includes a second power group at a second frame side, the second power group including a plurality of second power group drawstring pulleys, at least one of the plurality of second power group drawstring pulleys being attached to the frame, wherein the drawstring is configured to be routed at least partially around the second power group drawstring pulleys.

In Example 10, the projectile launcher of Example 9 is modified to further include a drawstring having first and a second drawstring ends, the drawstring traveling at least partially perpendicular to the projectile axis between the first and the second drawstring ends. The drawstring is movable within the projectile plane during firing and arming of the projectile launcher. The plurality of first and second power group drawstring pulleys are configured to reduce a draw weight of the drawstring.

In Example 11, the projectile launcher of Example 9 is modified to further include a power source. The first power group and the second power group are connected to the power source via a drawstring.

In Example 12, the projectile launcher of Example 11 is modified in that the power source further comprises a first flexible limb and a second flexible limb, each first and second limb having a first end attached to the frame and a second end. The first and second flexible limbs are in an unloaded position when the projectile launcher is undrawn and in a loaded position when the projectile launcher is drawn. The first power group includes the plurality of first power group drawstring pulleys and the first flexible limb, and the second power group includes the plurality of second power group drawstring pulleys and the second flexible limb.

In Example 13, the projectile launcher of Example 9 is modified in that the projectile launcher is a crossbow and the frame includes a stock being positioned at a rear end of the frame, the stock being configured to be positioned against an operator's shoulder.

In Example 14, the projectile launcher of Example 9 is modified in that the projectile launcher is a slingshot having a vertical grip.

In Example 15, the projectile launcher of Example 9 is modified in that each of the first and second power group drawstring pulleys include a groove configured to receive a drawstring therein.

In Example 16, the projectile launcher of Example 9 is modified in that the plurality of first power group drawstring pulleys include a plurality of first frame pulleys attached to the frame, wherein the plurality of first frame pulleys are positioned around a single shaft and separated from one another via a spacer. The first power group further includes a plurality of first limb pulleys attached to the first flexible limb, wherein the plurality of first limb pulleys are positioned around a single shaft and separated from one another via a spacer.

In Example 17, the projectile launcher of Example 16 is modified in that the plurality of second power group drawstring pulleys include a plurality of second frame pulleys attached to the frame, wherein the plurality of frame drawstring pulleys of the second power group are positioned around a single shaft and separated from one another via a spacer. The second power group further includes a plurality of limb drawstring pulleys attached to the second flexible limb, wherein the plurality of limb drawstring pulleys of the second power group are positioned around a single shaft and separated from one another via a spacer.

In Example 18, a method of forming a projectile launcher includes providing a projectile launcher. The projectile launcher includes a frame defining a horizontal projectile plane at a top side in which a projectile axis is positioned. A projectile moves within the horizontal projectile plane and along the projectile axis during firing and arming of the projectile launcher, and the projectile is fired from a front end of the frame. The projectile launcher also includes a first power group at a first frame side, the first power group including a plurality of first power group drawstring pulleys, at least one of the plurality of first power group drawstring pulleys being attached to the frame. The projectile launcher further includes a second power group at a second frame side, the second power group including a plurality of second power group drawstring pulleys, at least one of the plurality of second power group drawstring pulleys being attached to the frame. The projectile launcher further includes a power source connectable to the first and second power groups via a drawstring. The method further includes connecting the power source to a first end of the drawstring, routing the drawstring at least partially around the first power group drawstring pulleys, routing the drawstring at least partially around the second power group drawstring pulleys, and connecting the power source to a second end of a drawstring.

In Example 19, the method of Example 18 is modified in that the projectile launcher is a slingshot having a vertical grip.

In Example 20, the method of Example 18 is modified in that the projectile launcher is a crossbow and the frame includes a stock being positioned at a rear end of the frame, the stock being configured to be positioned against an operator's shoulder.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A projectile launcher comprising:

a frame defining a horizontal projectile plane at a top side in which a projectile axis is positioned;

a flexible limb having a first end attached to the frame and a second end;

a power group associated with the flexible limb and including at least three coaxial, separately rotatable power group drawstring pulleys rotatably coupled to the flexible limb; and a drawstring having first and second drawstring ends, the drawstring traveling at least partially perpendicular to the projectile axis between the first and the second drawstring ends and engaged with the power group drawstring pulleys.

2. The projectile launcher of claim 1, wherein the projectile launcher is a crossbow and the frame includes a stock being positioned at a rear end of the frame.

3. The projectile launcher of claim 2, further comprising a projectile rest positioned at a front end of the frame.

4. The projectile launcher of claim 2, further comprising a latch configured to interface with the drawstring, the latch being configured to receive and retain the drawstring at the rear end of the frame.

5. The projectile launcher of claim 1, wherein the power group further includes a plurality of coaxial frame pulleys rotatably coupled to the frame, the drawstring coupled to the plurality of coaxial frame pulleys and the at least three coaxial, separately rotatable power group drawstring pulleys.

6. The projectile launcher of claim 5, wherein the plurality of coaxial frame pulleys are coaxially mounted about a frame pulley axis, wherein the three coaxial, separately rotatable power group drawstring pulleys are coaxially mounted about a limb pulley axis, and wherein the frame pulley axis and the limb pulley axis are parallel.

7. The projectile launcher of claim 1, further comprising a second power group associated with a second flexible limb and including at least three coaxial second power group drawstring pulleys rotatable coupled to the second limb; and wherein the second power group drawstring pulleys further include a plurality of pulleys attached to the frame.

8. The projectile launcher of claim 5, wherein the plurality of coaxial frame pulleys attached to the frame are positioned around a single shaft and separated from one another via a spacer.

9. The projectile launcher of claim 1, wherein each of the at least three power group pulleys are configured to rotate about a pulley axis when the drawstring is pulled into a drawn position.

10. The projectile launcher of claim 1, wherein the drawstring contacts at least half of a circumference of each of the pulleys in the power group.

11. A projectile launcher comprising:

a frame defining a horizontal projectile plane at a top side in which a projectile axis is positioned;

a flexible limb including a first end attached to the frame and a second end;

a power group at a first frame side, the power group including a plurality of separately rotatable power group drawstring pulleys, at least one of the plurality of power group drawstring pulleys being attached to the frame, at least one of the plurality of power group drawstring pulleys being attached to the flexible limb, and at least three of the plurality of power group drawstring pulleys positioned around a single shaft and separated from one another via a spacer; and a guide pulley coupled to the frame, the guide pulley positioned downrange from the plurality of power group drawstring pulleys along the projectile axis.

12. The projectile launcher of claim 11, further comprising a drawstring having first and second drawstring ends, the drawstring traveling at least partially perpendicular to the projectile axis between the first and the second drawstring ends, the drawstring being movable within a projectile plane during firing and arming of the projectile launcher, wherein the drawstring is directly routed at least partially around the at least three plurality of power group drawstring pulleys.

13. The projectile launcher of claim 11, wherein the projectile launcher is a crossbow and the frame includes a stock being positioned at a rear end of the frame.

14. The projectile launcher of claim 12, wherein each of the power group drawstring pulleys include a groove configured to receive the drawstring therein.

15. The projectile launcher of claim 11, further comprising a second power group at a second frame side, the second power group including at least three coaxial second power group drawstring pulleys, wherein the at least three coaxial second power group drawstring pulleys are positioned around a single shaft and separated from one another via a second spacer.

* * * * *